US008864563B2

(12) United States Patent
Rakestraw

(10) Patent No.: US 8,864,563 B2
(45) Date of Patent: Oct. 21, 2014

(54) ELECTRONIC GAMING DEVICE WITH PHYSICS-BASED GAMING FUNCTIONALITY

(71) Applicant: Simon Nicolas Rakestraw, Decatur, GA (US)

(72) Inventor: Simon Nicolas Rakestraw, Decatur, GA (US)

(73) Assignee: Cadillac Jack, Inc., Duluth, GA (US)

( * ) Notice: Subject to any disclaimer, the term of this patent is extended or adjusted under 35 U.S.C. 154(b) by 130 days.

(21) Appl. No.: 13/625,509

(22) Filed: Sep. 24, 2012

(65) Prior Publication Data

US 2014/0087819 A1 Mar. 27, 2014

(51) Int. Cl.
*G07F 17/32* (2006.01)

(52) U.S. Cl.
USPC ..... 463/16; 463/20; 463/25; 463/31

(58) Field of Classification Search
USPC ..... 463/16, 20, 31
IPC ..... G07F 17/32
See application file for complete search history.

(56) References Cited

U.S. PATENT DOCUMENTS

| | | | | |
|---|---|---|---|---|
| 6,139,429 | A * | 10/2000 | Shoemaker, Jr. | 463/7 |
| 7,513,505 | B2 * | 4/2009 | Berman et al. | 273/447 |
| 2004/0018865 | A1 * | 1/2004 | Gilmore et al. | 463/7 |

* cited by examiner

*Primary Examiner* — Omkar Deodhar
(74) *Attorney, Agent, or Firm* — CF3; Stephen Eisenmann

(57) ABSTRACT

Examples disclosed herein relate to systems and methods, which may receive wagers on one or more paylines. The systems and methods may utilize one or more objects in a physics-based game. The systems and methods may determine one or more payouts based on the one or more objects. The systems and methods may display one or more presentations based on the one or more objects.

17 Claims, 14 Drawing Sheets

ELECTRONIC GAMING DEVICE WITH PHYSICS-BASED GAMING FUNCTIONALITY

FIELD

The subject matter disclosed herein relates to an electronic gaming device. More specifically, the disclosure relates to an electronic gaming device, which provides game play based on physics-based functionality (e.g., crane, pinball, and/or other similar functionality). Further, the disclosure relates to utilizing physics-based functionality (e.g., crane, pinball, and/or other similar functionality) and presentations in the base game and/or the bonus game to enhance the gaming experience.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successful matches the predetermined winning symbols in one of the predetermined patterns. One or more combinations of symbols may generate a bonus game. A new way of delivering game play includes providing physics-based functionality (e.g., crane, pinball, and/or other similar functionality) in the base game and/or the bonus game.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION

Figure 1:
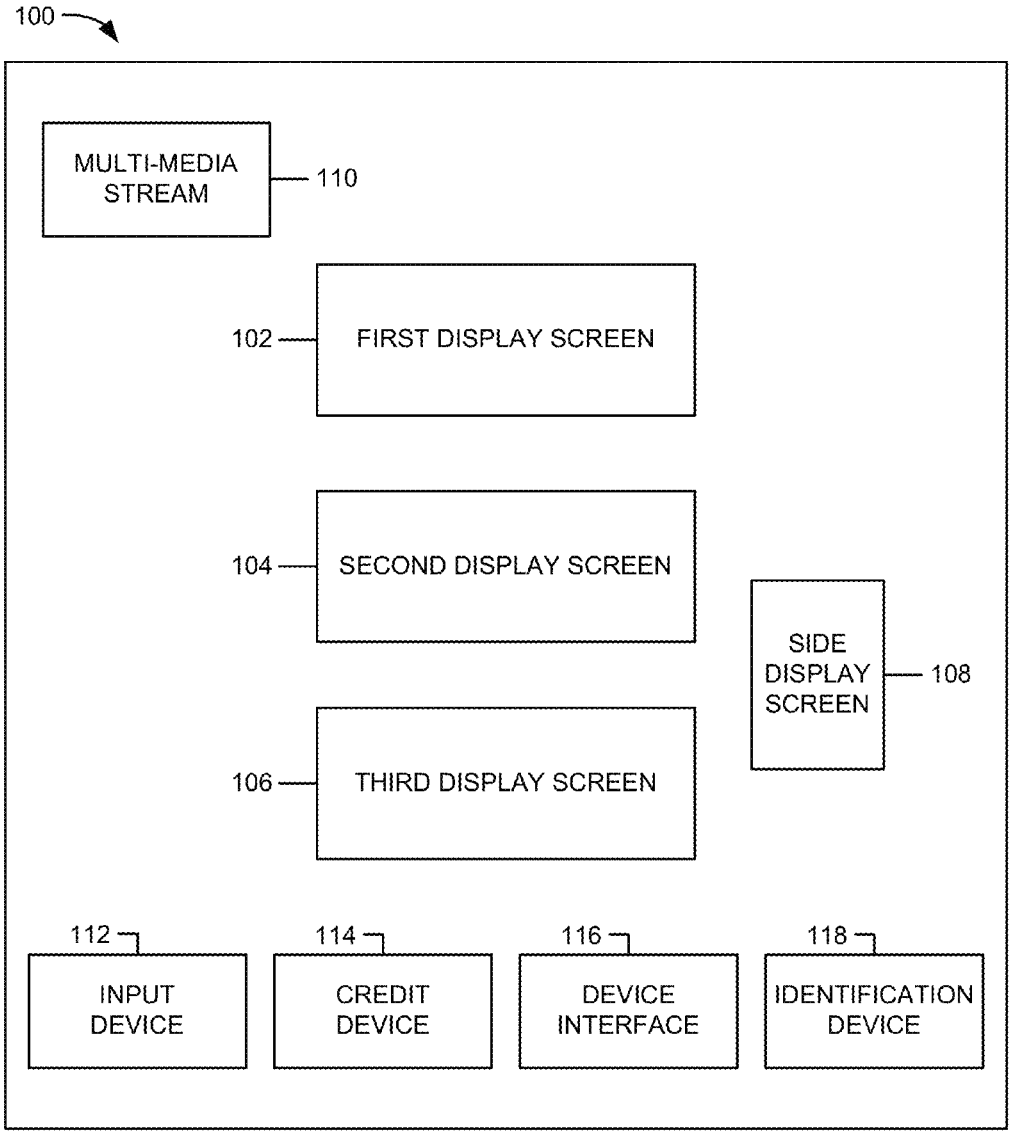
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to make a wager, to control any object (e.g., virtual crane, crane, pinball, virtual pinball, flipper, sling shot, gun, etc.), to select one or more pattern gaming options, to obtain data relating to historical payouts, to select a row and/or column to move, to select a row area to move, to select a column area to move, to select a symbol to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel (see FIG. 5B and FIG. 6B).

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more physics-based functionalities (e.g., crane, pinball, and/or other similar functionality) may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, a player may want to have game play which has only crane based functionality (or similar functionality). Therefore, no games without crane based functionality would be presented. In another example, the player may only want to play games that include pattern gaming options only. Therefore, only games which include pattern gaming options would be presented to the player. In another example, the player may only want to play games that include historical information relating to game play. Therefore, only games which include historical gaming data would be presented to the player.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

The presentations associated with physics-based game play (e.g., crane, pinball, and/or other similar functionality) may be presented on one, a few, and/or a plurality of screens. These presentations associated with physics-based game play (e.g., crane, pinball, and/or other similar functionality) may be displayed on a portion of one, a few, and/or a plurality of these screens.

For example, a single large image could be partially displayed on second display screen 104 and partially displayed on third display screen 106, so that when both display screens are put together they complete one image. Electronic gaming device 100 may stream or play prerecorded multi-media data, which may be displayed on any display combination.

Figure 2:
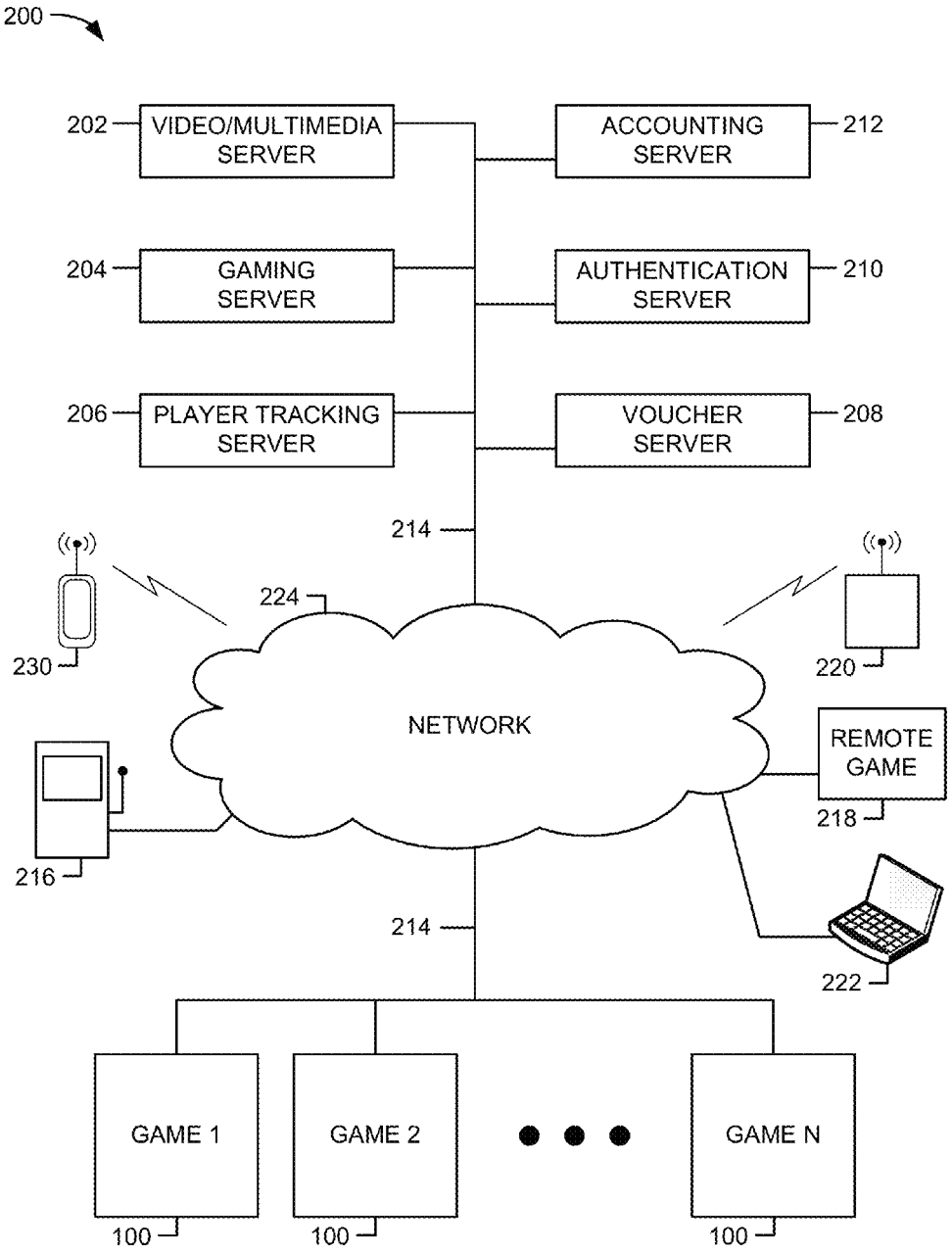
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of a payout functionality, a crane functionality, a crane evaluation functionality, other physical game functionality, and/or any other virtual game functionality.

For example, a pinball gaming structure may be another physical game functionality. In another example, a virtual pinball gaming structure may be another virtual game functionality. In another example, a virtual weapon to target gaming function may be another virtual game functionality. In another example, a sling shot may be another physical and/or virtual game functionality. In another example, a coin drop may be another physical and/or or virtual game functionality. There are many different gaming options, which may be utilized in physical and/or virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include crane based game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Statistics server may include data relating to one or more crane based game play (or similar game play). This data may include the number of time a specific item (e.g., cherry, bear, dog, star) was selected (e.g., picked up, hit, etc.). The frequency of any specific item being selected and the amount won. This data may also include data relating to any interrelationship of elements. For example, when the cherry is selected (e.g., first object) with a pick, the dog is selected 85% of the time (e.g., second object) with the next pick.

Figure 3:
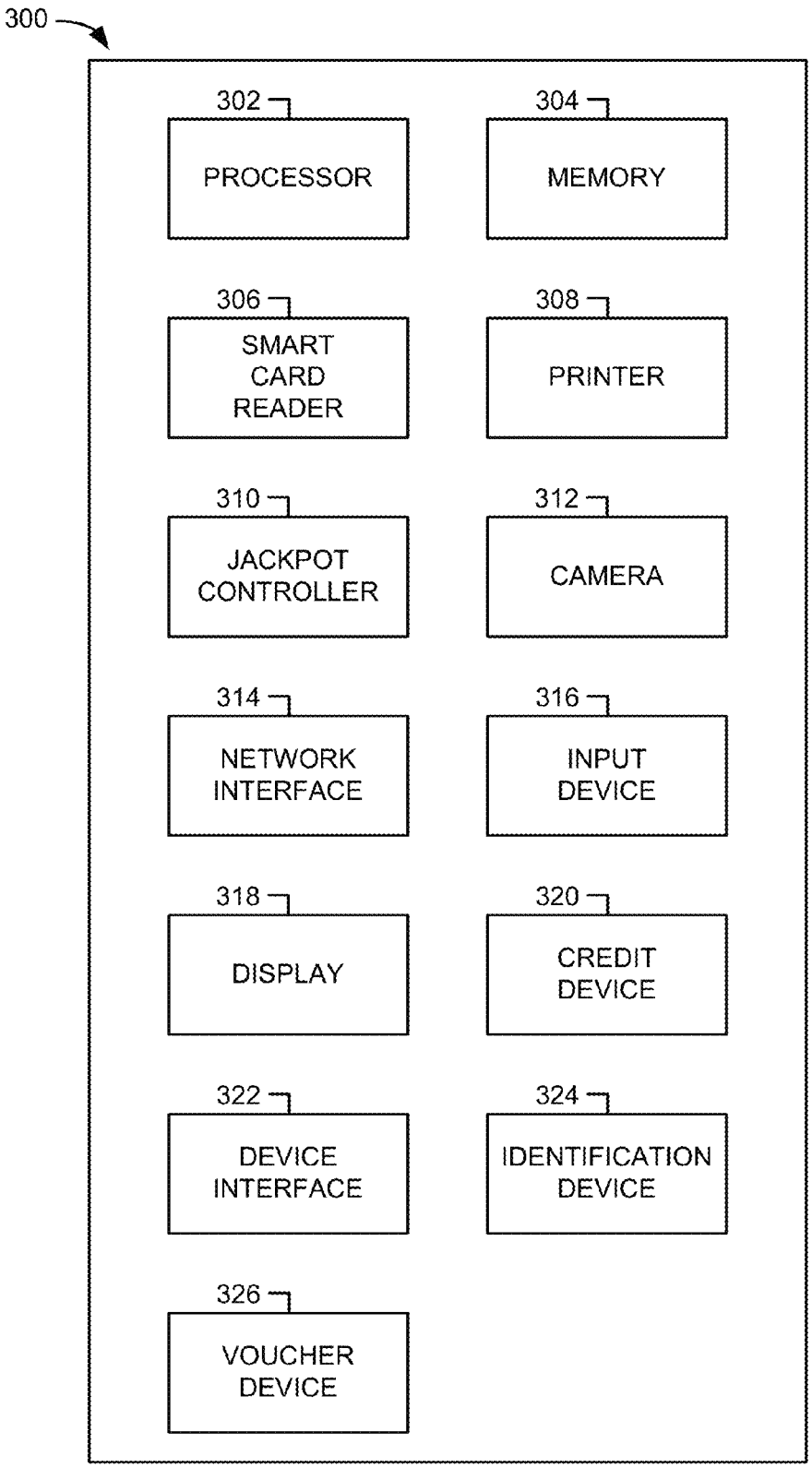
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine their picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more game elements, to make an offer to buy or sell a voucher, to determine a vouchers worth, to cash in a voucher, to modify electronic gaming device 100 (e.g., change sound level, configuration, font, language, etc.), to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
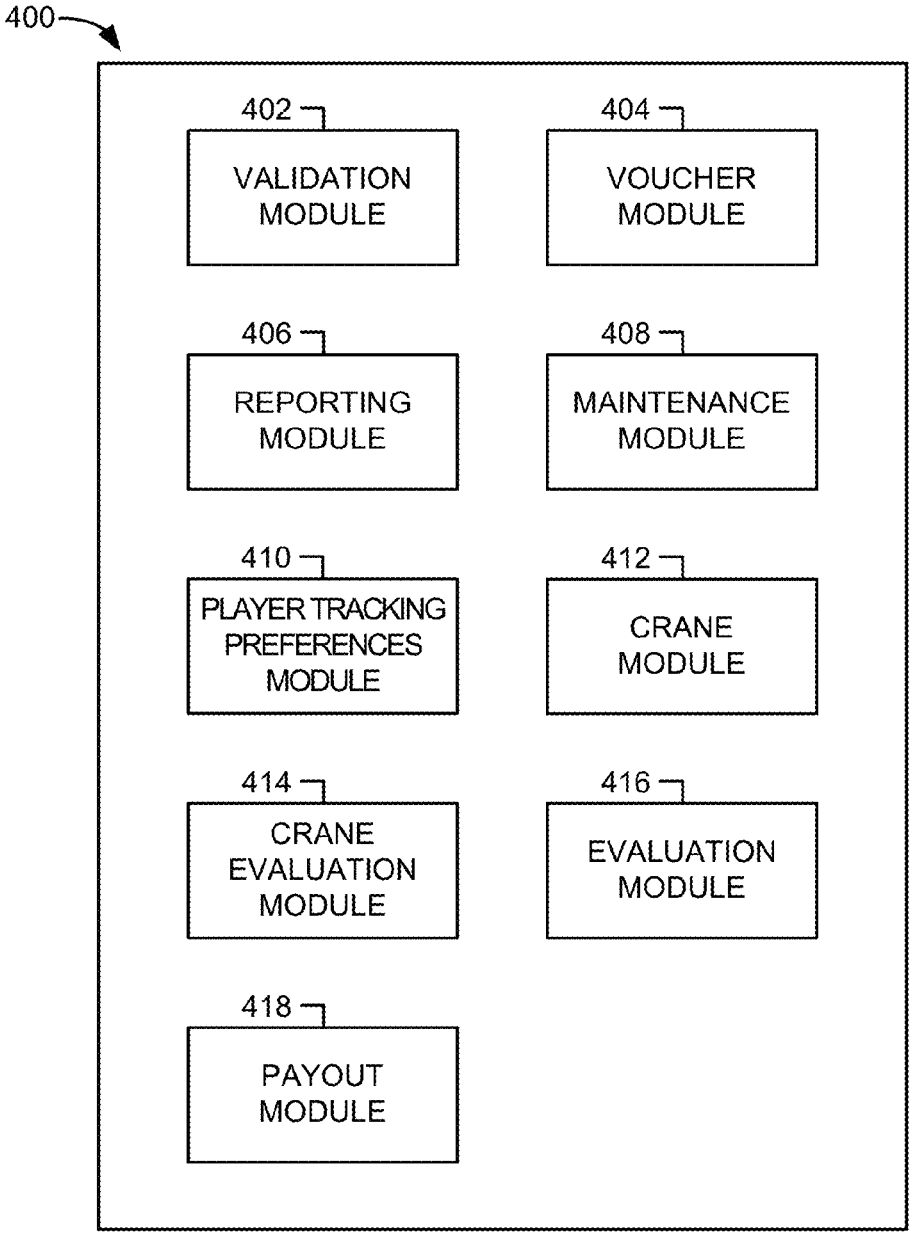
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, a crane module 412, a crane evaluation module 414, an evaluation module 416, and/or a payout module 418.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Crane module 412 may represent an example of a physics-based gaming module. Crane module 412 may include one or more crane structures, one or more crane characteristics, one or more crane categories, one or more crane presentations, and/or one or more prize pools. For example, a first crane structure may have a first size (e.g., big, small, medium, huge, very small, etc.) with a first size picker (e.g., big, small, medium, huge, very small, etc.). The first crane structure may have a first drop length (e.g., short, long, medium). In another example, a second crane structure may have a second size, a second size picker, and a second drop length (e.g., short, long, medium). There may be numerous drop lengths (e.g., very short, short, small, medium, above average, long, tall, very tall, huge, etc.). There may be numerous picker sizes (e.g., very short, short, small, medium, above average, long, tall, very tall, huge, wide, etc.).

In another example, the crane characteristics (e.g., speed, size, gripping pressure, gripping area, stability, etc.) may be utilized to vary game play. In one example, the crane may be large, be very stable, move slowly, and have a high gripping pressure, which may be advantages when trying to pick up items. In another example, the crane may be large, move very fast, be unstable, and have a low gripping pressure, which may not be advantages when trying to pick up items. In another example, the crane may be small, be very stable, but has a low gripping pressures, which may be neutral (e.g., an average structure for picking up items) when trying to pick up items.

Crane module 412 may include data relating to one or more crane locations. Crane module 412 may include data relating to one or more characteristics (e.g., height, slope, angle, length, speed, etc.) for the one or more crane locations.

In another example, the crane categories may include a first category type (e.g., easy), a second category type (e.g., average), a third category type (e.g., hard), a fourth category type (e.g., expert), and/or any other category. For example, the first category may have crane characteristics (e.g., slow, stable, high gripping pressure, etc.), which makes the ability to pick up an item and/or a specific item easy. Second category type may have crane characteristics (e.g., average speed, stable, low gripping pressure, etc.), which makes the ability to pick up an item and/or a specific item an average skill level task. Third category may have crane characteristics (e.g., fast, stable, low gripping pressure, above-average angle difficultly, etc.), which makes the ability to pick up an item and/or a specific item a hard task. Fourth category may have crane characteristics (e.g., very fast, unstable, low gripping pressure, small picking area, low gripping pressure, difficult angle, etc.), which makes the ability to pick up an item and/or a specific item an expert level task.

In another example, crane presentations may include one or more presentations based on one or more themes, one or more crane structures, one or more crane characteristics, one or more crane categories, one or more crane locations, and/or one or more prize pools.

In another example, one or more prize pools may be associated with one or more crane structures, one or more crane characteristics, one or more crane presentations, one or more crane locations, and/or crane categories. For example, a small prize pool (e.g., low payout, lower top winning prize, etc.) may be associated with a first category (e.g., easy crane category). In another example, a medium prize pool (e.g., medium payout, medium top winning prize, etc.) may be associated with a second category (e.g., medium crane category). In another example, a large prize pool (e.g., large payout, large top winning prize, etc.) may be associated with a third category (e.g., hard crane category). In another example, a grand prize pool (e.g., largest payout, largest top winning prize, etc.) may be associated with a fourth category (e.g., expert crane category).

For example, a small prize pool (e.g., highest payout, highest top winning prize, etc.) may be associated with a first category (e.g., easy crane category). In another example, a large prize pool (e.g., large payout, large top winning prize, etc.) may be associated with a second category (e.g., medium crane category). In another example, a medium prize pool (e.g., medium payout, medium top winning prize, etc.) may be associated with a third category (e.g., hard crane category). In another example, a smallest prize pool (e.g., smallest payout, smallest top winning prize, etc.) may be associated with a fourth category (e.g., expert crane category).

These payout pools and any of the other segments (e.g., crane structures, crane characteristics, crane categories, crane presentations, etc.) may be mixed and matched as needed. The game may be skill based. Therefore, the outcome may depend on a player's input. The game may not be skill based. Therefore, the outcome may not depend on a player's input. The game may have a perceived skill function. Therefore, the outcome appears to depend on a player's input but the outcome does not depend on a player's input.

Crane evaluation module 414 may evaluate game play in either a base game and/or a bonus game. Crane evaluation module 414 may store a plurality of payout structures relating to crane game play. Crane evaluation module 414 may be another game structure evaluation module. For example, crane evaluation module 414 may be one or more of a pinball evaluation module, a sling shot evaluation module, a weapon-target evaluation module, a coin drop evaluation module, and/or any other game play evaluation module.

Another game structure evaluation module may include data relating to one or more objects (e.g., pinball game, sling shot, coin drop, weapon-target, etc.). Another game structure evaluation module may include data relating to one or more objects characteristics. This data may include data relating to one or more characteristics (e.g., location, height, slope, speed, force, mass, angles, velocity, resistances, streaming shots, shells, accuracy, spread, aiming function, health, strength, size, color, image, recovery powers, load time, firing time, skill based functions, perceived skill-based functionality, upgradable, damage—effectiveness, etc.) for the one or more objects.

Evaluation module 416 may evaluate game play in either a base game and/or a bonus game. Evaluation module 416 may store a plurality of payout structures.

Payout module 418 may determine payouts in either a base game and/or a bonus game. Payout module 414 may include data relating to a plurality of payouts.

It should be noted that any of the modules may be replaced by any other object module (e.g., person, machine, tool, animal, structure, obstacles, theme, etc.).

A bonus module may generate a bonus game, evaluate the results of the bonus game, trigger bonus game presentations, generate bonus game payouts, and/or display any data relating to the bonus game.

A presentation generation module may generate the presentation data (e.g., visual and audio) relating to one or more game play options. A presentation module may display one or more of the generated presentations.

It should be noted that one or more modules may be combined into one module. Further, there may be one evaluation module where the determined payout does not depend on whether there were any wild symbols, scatter symbols, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5A:
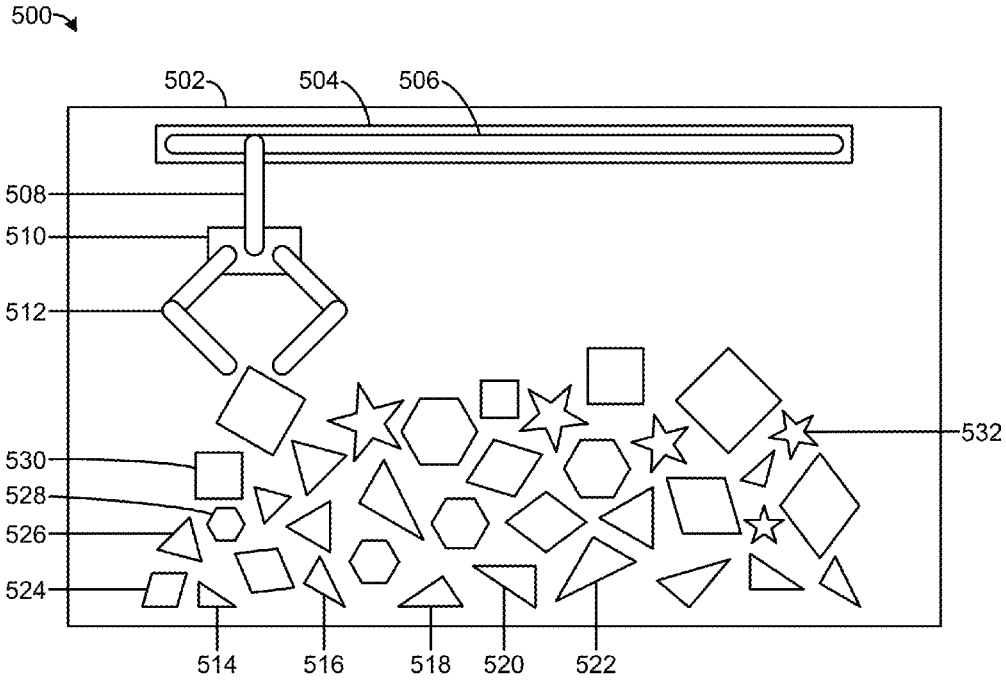
FIG. 5A is an illustration of a crane-based game play, according to one embodiment.

FIG. 5A is an illustration of a crane-based game play, according to one embodiment. FIG. 5A shows a screen image 500 for electronic gaming device 100 on display 318. Screen image 500 may include a display area 502, a track 504, an inner track guide 506, a crane support 508, a crane box 510, a crane picker 512, a first object 514, a second object 516, a third object 518, a fourth object 520, a fifth object 522, a sixth object 524, a seventh object 526, an eighth object 528, a ninth object 530, and/or a tenth object 532.

Display area 502 may be utilized to display any physics-based gaming functionality (e.g., crane, pinball, and/or other similar functionality). In this example, the physics-based gaming functionality is a crane-based game.

Track 504 may include an inner track guide 506. Track 504 and/or inner track guide 506 may determine how crane may be moved. In this case, track 504 and/or inner track guide 506 may determine that crane may move in a straight horizontal direction. It should be noted that any movement pattern may be utilized (e.g., vertical, horizontal, any angled movement, and/or any combination thereof).

Crane support 508 may be utilized to connect track 504 and/or inner track guide 506 with crane box 510. Crane support 508 may be able to move inside of track 504 and/or inner track guide 506. Crane support 508 may be connected to crane picker 512. Crane picker 512 may be utilized to pick up items (e.g., prizes, objects, etc.). Crane picker 512 may pick up first object 514, second object 516, a third object 518, a fourth object 520, a fifth object 522, a sixth object 524, a seventh object 526, an eighth object 528, a ninth object 530, tenth object 532, and/or Nth object.

First object 514 may be a first picking object. First object 514 may be a first type of prize (e.g., credits, free spins, multiplier, multi-level selections, free food, free room, free event tickets, and/or any other thing of value). In this example, the first prize type is a credit amount. First object 514 may be a first sized object (e.g., small). First object 514 may be the hardest object to pick up. First object 514 may be the hardest object to pick up in first picking object classification. First object 514 may be associated with the largest prize pool. First object 514 may be associated with the largest prize pool in first picking object classification. First object 514 may be associated with the largest prize pool based on the being the hardest object to pick up. First object 514 may be associated with any prize pool, crane category, crane presentation, crane structure, and/or any combination thereof based on any first object characteristic (e.g., hardest object to pick up, easiest object to pick up, largest object, smallest object, average sized object, size 1 object, size 2 object, category 1 object, category 2 object, prize amount 1 object, prize amount 2 object, etc.).

Second object 516 may be a first picking object. Second object 516 may be a first type of prize (e.g., credits, free spins, multiplier, multi-level selections, free food, free room, free event tickets, and/or any other thing of value). Second object 516 may be a second sized object (e.g., the second smallest). Second object 516 may be the second hardest object to pick up. Second object 516 may be the second hardest object to pick up in first picking object classification. Second object 516 may be associated with the second largest prize pool. Second object 516 may be associated with the second largest prize pool in first picking object classification. Second object 516 may be associated with the second largest prize pool based on the being the second hardest object to pick up. Second object 516 may be associated with any prize pool, crane category, crane presentation, crane structure, and/or any combination thereof based on any second object characteristic (e.g., hardest object to pick up, second hardest object to pick up, easiest object to pick up, second easiest to pick up, largest object, smallest object, average sized object, size 1 object, size 2 object, category 1 object, category 2 object, prize amount 1 object, prize amount 2 object, etc.).

Third object 518 may be a first picking object. Third object 518 may be a first type of prize (e.g., credits, free spins, multiplier, multi-level selections, free food, free room, free event tickets, and/or any other thing of value). Third object 516 may be a third sized object (e.g., an average sized object=third smallest and the third biggest). Third object 518 may be the third hardest object to pick up. Third object 518 may be the third hardest object to pick up in first picking object classification. Third object 518 may be associated with the third largest prize pool. Third object 518 may be associated with the third largest prize pool in first picking object classification. Third object 518 may be associated with the third largest prize pool based on the being the third hardest object to pick up. Third object 518 may be associated with any prize pool, crane category, crane presentation, crane structure, and/or any combination thereof based on any third object characteristic (e.g., hardest object to pick up, second hardest object to pick up, third hardest to pick up, easiest object to pick up, second easiest to pick up, largest object, smallest object, average sized object, size 1 object, size 2 object, category 1 object, category 2 object, prize amount 1 object, prize amount 2 object, etc.).

Fourth object 520 may be a first picking object. Fourth object 520 may be a first type of prize (e.g., credits, free spins, multiplier, multi-level selections, free food, free room, free event tickets, and/or any other thing of value). Fourth object 520 may be a fourth sized object (e.g., the second biggest object). Fourth object 520 may be the second easiest object to pick up. Fourth object 520 may be the second easiest object to pick up in first picking object classification. Fourth object 520 may be associated with the second smallest prize pool. Fourth object 520 may be associated with the second smallest prize pool in first picking object classification. Fourth object 520 may be associated with the second smallest prize pool based on the being the second easiest object to pick up. Fourth object 520 may be associated with any prize pool, crane category, crane presentation, crane structure, and/or any combination thereof based on any fourth object characteristic (e.g., hardest object to pick up, second hardest object to pick up, third hardest to pick up, easiest object to pick up, second easiest to pick up, largest object, smallest object, average sized object, size 1 object, size 2 object, category 1 object, category 2 object, prize amount 1 object, prize amount 2 object, etc.).

Fifth object 522 may be a first picking object. Fifth object 522 may be a first type of prize (e.g., credits, free spins, multiplier, multi-level selections, free food, free room, free event tickets, and/or any other thing of value). Fifth object 522 may be a fifth sized object (e.g., the biggest object). Fifth object 522 may be the easiest object to pick up. Fifth object 522 may be the easiest object to pick up in first picking object classification. Fifth object 522 may be associated with the smallest prize pool. Fifth object 522 may be associated with the smallest prize pool in first picking object classification. Fifth object 522 may be associated with the smallest prize pool based on the being the easiest object to pick up. Fifth object 522 may be associated with any prize pool, crane category, crane presentation, crane structure, and/or any combination thereof based on any fifth object characteristic (e.g., hardest object to pick up, second hardest object to pick up, third hardest to pick up, easiest object to pick up, second easiest to pick up, largest object, smallest object, average sized object, size 1 object, size 2 object, category 1 object, category 2 object, prize amount 1 object, prize amount 2 object, etc.).

Sixth object 524 may be a second picking object. Sixth object 524 may be a second type of prize (e.g., credits, free spins, multiplier, multi-level selections, free food, free room, free event tickets, and/or any other thing of value). In this example, second prize type may be free spins. Sixth object 524 may be a first sized object (e.g., small). Second picking object may include many different sized (e.g., smallest, second smallest, medium, second biggest, biggest, any size from 1 to N) objects. Sixth object 524 may be the hardest object to pick up. Sixth object 524 may be the hardest object to pick up in second picking object classification. Sixth object 524 may be associated with the largest prize pool. Sixth object 524 may be associated with the largest prize pool in second picking object classification. Sixth object 524 may be associated with the largest prize pool based on the being the hardest object to pick up. Sixth object 524 may be associated with any prize pool, crane category, crane presentation, crane structure, and/or any combination thereof based on any sixth object characteristic (e.g., hardest object to pick up, easiest object to pick up, largest object, smallest object, average sized object, size 1 object, size 2 object, category 1 object, category 2 object, prize amount 1 object, prize amount 2 object, etc.).

Seventh object 526 may be a third picking object. Seventh object 526 may be a third type of prize (e.g., credits, free spins, multiplier, multi-level selections, free food, free room, free event tickets, and/or any other thing of value). In this example, third prize type may be a multiplier. Seventh object 526 may be a first sized object (e.g., small). Third picking object may include many different sized (e.g., smallest, second smallest, medium, second biggest, biggest, any size from 1 to N) objects. Seventh object 526 may be the hardest object to pick up. Seventh object 526 may be the hardest object to pick up in third picking object classification. Seventh object 526 may be associated with the largest prize pool. Seventh object 526 may be associated with the largest prize pool in third picking object classification. Seventh object 526 may be associated with the largest prize pool based on the being the hardest object to pick up. Seventh object 526 may be associated with any prize pool, crane category, crane presentation, crane structure, and/or any combination thereof based on any seventh object characteristic (e.g., hardest object to pick up, easiest object to pick up, largest object, smallest object, average sized object, size 1 object, size 2 object, category 1 object, category 2 object, prize amount 1 object, prize amount 2 object, etc.).

Eighth object 528 may be a fourth picking object. Eighth object 528 may be a fourth type of prize (e.g., credits, free spins, multiplier, multi-level selections, free food, free room, free event tickets, and/or any other thing of value). In this example, fourth prize type may be credits and free spins. Eighth object 528 may be a first sized object (e.g., medium). Fourth picking object may include many different sized (e.g., smallest, second smallest, medium, second biggest, biggest, any size from 1 to N) objects. Eighth object 528 may be an average difficultly object to pick up. Eighth object 528 may be an average difficultly object to pick up in fourth picking object classification. Eighth object 528 may be associated with an average sized prize pool. Eighth object 528 may be associated with an average sized prize pool in fourth picking object classification. Eighth object 528 may be associated with an average sized prize pool based on the being an average difficultly object to pick up. Eighth object 528 may be associated with any prize pool, crane category, crane presentation, crane structure, and/or any combination thereof based on any eighth object characteristic (e.g., hardest object to pick up, easiest object to pick up, largest object, smallest object, average sized object, size 1 object, size 2 object, category 1 object, category 2 object, prize amount 1 object, prize amount 2 object, etc.).

Ninth object 530 may be a fifth picking object. Ninth object 530 may be a fifth type of prize (e.g., credits, free spins, multiplier, multi-level selections, free food, free room, free event tickets, and/or any other thing of value). In this example, fifth prize type may be credits, free spins, and a multiplier. Ninth object 530 may be a first sized object (e.g., large). Fifth picking object may include many different sized (e.g., smallest, second smallest, medium, second biggest, biggest, any size from 1 to N) objects. Ninth object 530 may be the easiest object to pick up. Ninth object 530 may be the easiest object to pick up in fifth picking object classification. Ninth object 530 may be associated with the smallest prize pool. Ninth object 530 may be associated with the smallest prize pool in fifth picking object classification. Ninth object 530 may be associated with the smallest prize pool based on the being the easiest object to pick up. Ninth object 530 may be associated with any prize pool, crane category, crane presentation, crane structure, and/or any combination thereof based on any ninth object characteristic (e.g., hardest object to pick up, easiest object to pick up, largest object, smallest object, average sized object, size 1 object, size 2 object, category 1 object, category 2 object, prize amount 1 object, prize amount 2 object, etc.).

Tenth object 532 may be a sixth picking object. Tenth object 532 may be a sixth type of prize (e.g., credits, free spins, multiplier, multi-level selections, free food, free room, free event tickets, and/or any other thing of value). In this example, sixth prize type may be a multi-level selection. Tenth object 532 may be a first sized object (e.g., large). Sixth picking object may include many different sized (e.g., smallest, second smallest, medium, second biggest, biggest, any size from 1 to N) objects. Tenth object 532 may be the easiest object to pick up. Tenth object 532 may be the easiest object to pick up in sixth picking object classification. Tenth object 532 may be associated with the smallest prize pool. Tenth object 532 may be associated with the smallest prize pool in sixth picking object classification. Tenth object 532 may be associated with the smallest prize pool based on the being the easiest object to pick up. Tenth object 532 may be associated with any prize pool, crane category, crane presentation, crane structure, and/or any combination thereof based on any tenth object characteristic (e.g., hardest object to pick up, easiest object to pick up, largest object, smallest object, average sized object, size 1 object, size 2 object, category 1 object, category 2 object, prize amount 1 object, prize amount 2 object, etc.).

In one embodiment, a player, electronic gaming device 100, and/or electronic gaming system 200 may select one or more of first object 514, second object 516, third object 518, fourth object 520, fifth object 522, sixth object 524, seventh object 526, eighth object 528, ninth object 530, and/or tenth object 532.

In various examples, the player, electronic gaming device 100, and/or electronic gaming system 200 may select from 1 through $n^{th}$ of the picking objects available for selection. Any number of picking objects, characters, weapons, objects, obstacles, and/or selections may be utilized.

One or more of the objects may be stoppers, which may end game play. It should be noted that the objects may be any item (e.g., a person, a weapon, a structure, an animal, a vehicle, a tool, an instrument, a natural feature (e.g., hill, mountain, lake, sea, etc.), a machine, and/or any other item).

Game data area (not shown) may include additional data relating to the games. For example, a game menu, a bet amount, a winning total, a credit total, a betting increment (e.g., $0.01 per credit), an input button (e.g., move an object (e.g., crane, sling shot, etc.) select, play, deal, draw, shot, etc.), and/or any other gaming data may be shown.

Game menu button may include data relating to the game. For example, the payout structures, payout odds, the amount won over a predetermined number of game plays, the amount won over a specific time frame, and/or any other game play data may be accessed via game menu button. Game menu button may be utilized to change the game from a first game (e.g., slot machine theme 1) to a second game (e.g., slot machine theme 2, poker, blackjack, roulette, baccarat, craps, etc.). Game menu button may be utilized to change any other game structure (e.g., credit amounts). For example, the credit amount may be increased/decreased between $0.01 to $1.00 and/or any other values.

A bet reducer button (e.g., a downward arrow) may decrease the amount of credits wagered on game play. A bet amount image (e.g., 250) may show the amount of credits wagered on game play. A bet increaser button (e.g., an upward arrow) may increase the amount of credits wagered on game play. A credit amount image (e.g., 207,085) may show the amount of credits available to the player for game play. A win amount area (e.g., 1,000) may show the payout amount of the last event. A credit value image (e.g., $0.01) may show the value of a single credit. A play button may start the next game. A message area may display any message to the player. For example, the message may state "You Won 1,000 Credits. Congratulations!!!!!".

Figure 5B:
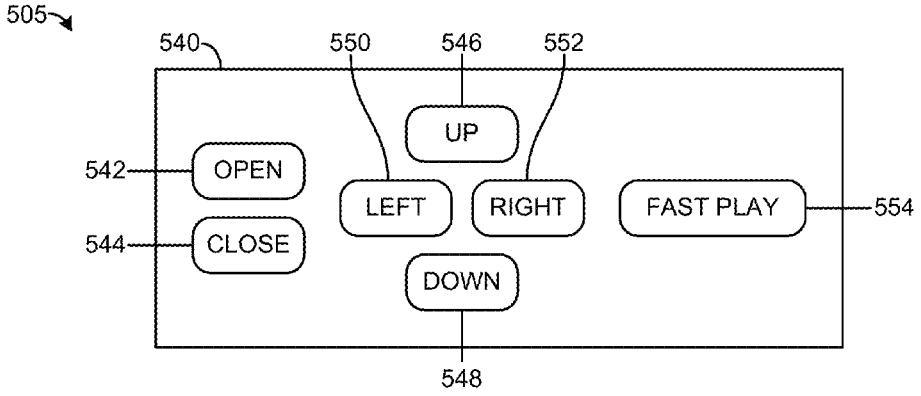
FIG. 5B is an illustration of a control panel for crane-based game play, according to one embodiment.

FIG. 5B is another illustration of a crane-based game play, according to one embodiment. A second image 505 may include a control area 540, an open button 542, a close button 544, a left button 550, a right button 552, an up button 546, a down button 548, and/or a fast play button 554.

Control area 540 may be an area where one or more buttons (e.g., input devices) are located. In this example, control area may include open button 542, close button 544, left button 550, right button 552, up button 546, down button 548, and fast play button 554. Open button 542 may be utilized to open up crane picker 512. Close button 544 may be utilized to close crane picker 512. Left button 550 may be utilized to move the crane to the left. Right button 552 may be utilized to move the crane to the right. Up button 546 may be utilized to move the crane up. Down button 548 may be utilized to move the crane down. Fast play button 554 may be utilized to speed up the game, automate the game (e.g., electronic gaming device 100 and/or electronic gaming system 200 selects the object), and/or reduce the presentations.

Figure 5C:
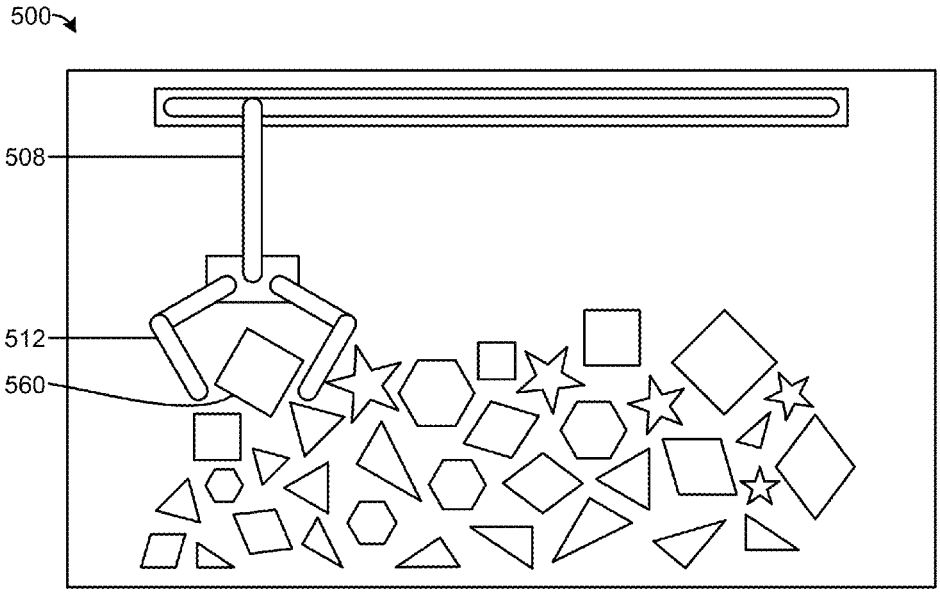
FIG. 5C is another illustration of a crane-based game play, according to one embodiment.

FIG. 5C shows another crane-based game play, according to one embodiment. In this example, crane support 508 has been extended to allow crane picker 512 to open and try to pick up a first prize object 560.

Figure 5D:
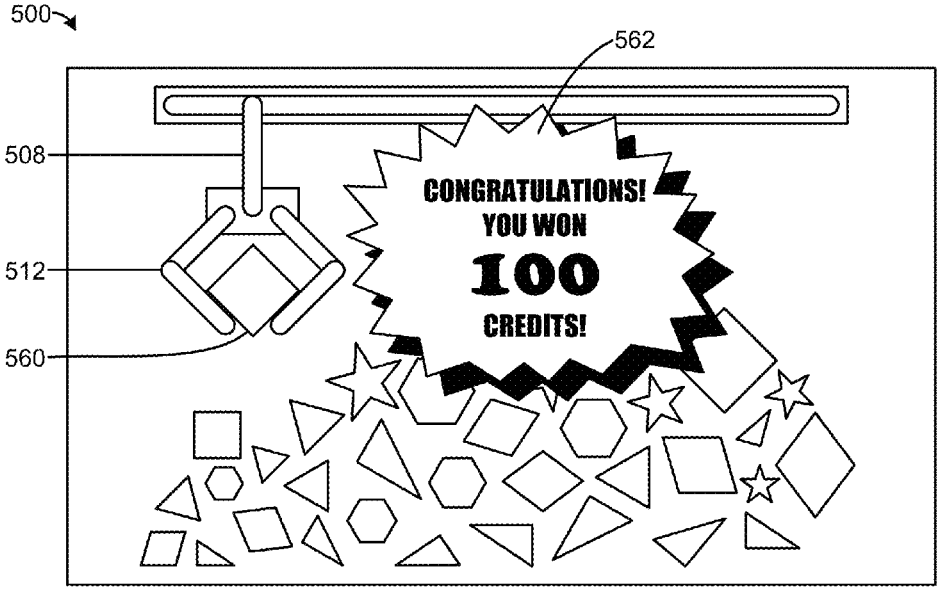
FIG. 5D is another illustration of a crane-based game play, according to one embodiment.

FIG. 5D shows another crane-based game play, according to one embodiment. In this example, crane picker 512 was able to pick up first prize object 560. First prize object 560 may be a 100 credit winning event, which was displayed by a first message 562. First message 562 may state "CONGRATULATIONS YOU WON 100 CREDITS!".

Figure 5E:
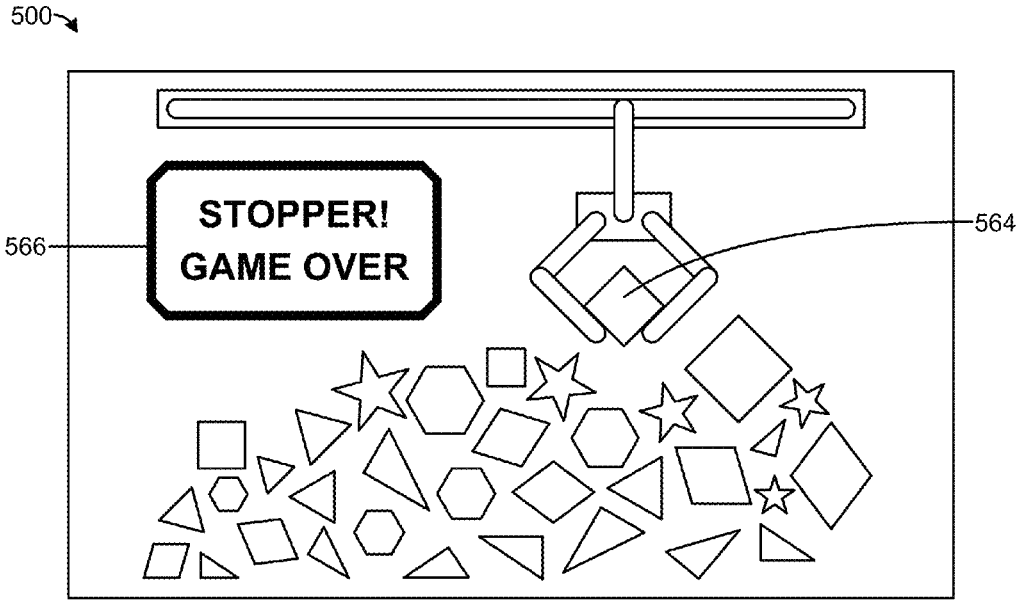
FIG. 5E is another illustration of a crane-based game play, according to one embodiment.

FIG. 5E shows another crane-based game play, according to one embodiment. In this example, crane picker 512 was able to pick up a second prize object 564. Second prize object 564 was a game ending stopper, which was displayed by a second message 566. Second message 566 may state "STOPPER! GAME OVER".

In another example, a multi-level item picking option may be utilized. In one example, if the player picks (e.g., picks up with the crane) an item which is a multi-level item, then the player may have the option to select one or more of multi-level selection option. In this example, if a player picks up an item with a multi-level selection characteristic, the system and/or method may display three images which may be selected by the player. In this example, the three images may reveal prizes of 1,000, 2,000, and 5,000 credits, respectively. Therefore, depending on which multi-level options is selected; the player may win 1,000 credits, 2,000 credits, or 5,000 credits. Any number of multi-level items may be utilized, along with any number of selections.

Figure 6A:
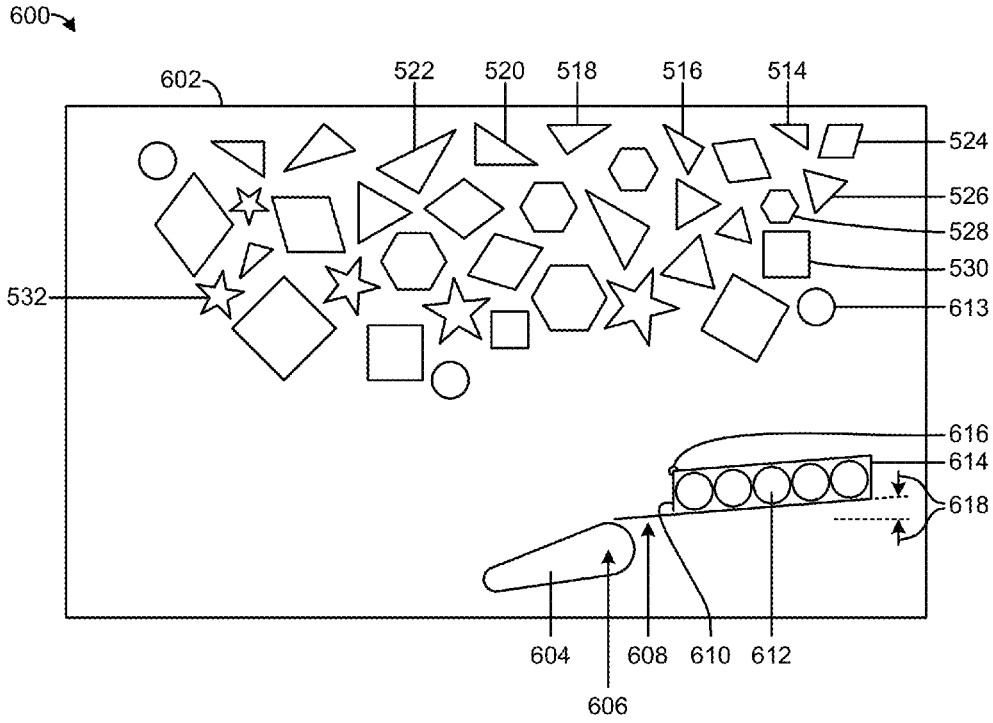
FIG. 6A is an illustration of a pinball-based game play, according to one embodiment.

FIG. 6A is an illustration of a pinball-based game play, according to one embodiment. A first pinball image 600 may include pinball area 602, first picking object 514, second picking object 516, third picking object 518, fourth picking object 520, fifth picking object 522, sixth picking object 524, seventh picking object 526, eighth picking object 528, ninth picking object 530, tenth picking object 532, a free ball object 612, a flipper 604, a flipper base 606, a ball ramp 608, a ball exit 610, a ball exit hinge 616, a ball area 614, a ball 612, and/or a ramp angle 618.

Flipper 604 may be utilized to move and/or launch ball 612 into one or more areas in pinball area 602. Flipper base 606 may be the pivot point for flipper 604. Ball ramp 608 may be an angled surface which may allow one or more balls 612 to travel towards flipper 604. The angle of ball ramp 608 may be adjusted by modifying ramp angle 618. Ramp angle may be modified by the player, electronic gaming device 100, and/or electronic gaming system 200 to any angle.

Ball exit 610 may be an opening in ball area 614 which allows one or more balls 612 to exit ball area 614 and travel towards flipper 604. Ball exit hinge 616 may be utilized to open and/or close ball exit 610. Ball area 614 may be an area where one or more balls 612 are stored.

First object 514 may be a first target object. First object 514 may be a first type of prize (e.g., credits, free spins, multiplier, multi-level selections, free food, free room, free event tickets, and/or any other thing of value). In this example, the first prize type is a credit amount and a multiplier. First object 514 may be a first sized object (e.g., small). First object 514 may be the hardest object to hit. First object 514 may be the hardest object to hit in first picking object classification. First object 514 may be associated with the largest prize pool. First object 514 may be associated with the largest prize pool in first picking object classification. First object 514 may be associated with the largest prize pool based on the being the hardest object to hit. First object 514 may be associated with any prize pool, crane category, crane presentation, crane structure, and/or any combination thereof based on any first object characteristic (e.g., hardest object to hit, easiest object to hit, largest object, smallest object, average sized object, size 1 object, size 2 object, category 1 object, category 2 object, prize amount 1 object, prize amount 2 object, etc.).

Second object 516 may be a first target object. Second object 516 may be a first type of prize (e.g., credits, free spins, multiplier, multi-level selections, free food, free room, free event tickets, and/or any other thing of value). Second object 516 may be a second sized object (e.g., the second smallest). Second object 516 may be the second hardest object to hit. Second object 516 may be the second hardest object to hit in first target object classification. Second object 516 may be associated with the second largest prize pool. Second object 516 may be associated with the second largest prize pool in first target object classification. Second object 516 may be associated with the second largest prize pool based on the being the second hardest object to hit. Second object 516 may be associated with any prize pool, crane category, crane presentation, crane structure, and/or any combination thereof based on any second object characteristic (e.g., hardest object to hit, second hardest object to hit, easiest object to hit, second easiest to hit, largest object, smallest object, average sized object, size 1 object, size 2 object, category 1 object, category 2 object, prize amount 1 object, prize amount 2 object, etc.).

Third object 518 may be a first target object. Third object 518 may be a first type of prize (e.g., credits, free spins, multiplier, multi-level selections, free food, free room, free event tickets, and/or any other thing of value). Third object 516 may be a third sized object (e.g., an average sized object=third smallest and the third biggest). Third object 518 may be the third hardest object to hit. Third object 518 may be the third hardest object to hit in first target object classification. Third object 518 may be associated with the third largest prize pool. Third object 518 may be associated with the third largest prize pool in first target object classification. Third object 518 may be associated with the third largest prize pool based on the being the third hardest object to hit. Third object 518 may be associated with any prize pool, crane category, crane presentation, crane structure, and/or any combination thereof based on any third object characteristic (e.g., hardest object to hit, second hardest object to hit, third hardest to hit, easiest object to hit, second easiest to hit, largest object, smallest object, average sized object, size 1 object, size 2 object, category 1 object, category 2 object, prize amount 1 object, prize amount 2 object, etc.).

Fourth object 520 may be a first target object. Fourth object 520 may be a first type of prize (e.g., credits, free spins, multiplier, multi-level selections, free food, free room, free event tickets, and/or any other thing of value). Fourth object 520 may be a fourth sized object (e.g., the second biggest object). Fourth object 520 may be the second easiest object to hit. Fourth object 520 may be the second easiest object to hit in first target object classification. Fourth object 520 may be associated with the second smallest prize pool. Fourth object 520 may be associated with the second smallest prize pool in first target object classification. Fourth object 520 may be associated with the second smallest prize pool based on the being the second easiest object to hit. Fourth object 520 may be associated with any prize pool, crane category, crane presentation, crane structure, and/or any combination thereof based on any fourth object characteristic (e.g., hardest object to hit, second hardest object to hit, third hardest to hit, easiest object to hit, second easiest to hit, largest object, smallest object, average sized object, size 1 object, size 2 object, category 1 object, category 2 object, prize amount 1 object, prize amount 2 object, etc.).

Fifth object 522 may be a first target object. Fifth object 522 may be a first type of prize (e.g., credits, free spins, multiplier, multi-level selections, free food, free room, free event tickets, and/or any other thing of value). Fifth object 522 may be a fifth sized object (e.g., the biggest object). Fifth object 522 may be the easiest object to hit. Fifth object 522 may be the easiest object to hit in first target object classification. Fifth object 522 may be associated with the smallest prize pool. Fifth object 522 may be associated with the smallest prize pool in first target object classification. Fifth object 522 may be associated with the smallest prize pool based on the being the easiest object to hit. Fifth object 522 may be associated with any prize pool, crane category, crane presentation, crane structure, and/or any combination thereof based on any fifth object characteristic (e.g., hardest object to hit, second hardest object to hit, third hardest to hit, easiest object to hit, second easiest to hit, largest object, smallest object, average sized object, size 1 object, size 2 object, category 1 object, category 2 object, prize amount 1 object, prize amount 2 object, etc.).

Sixth object 524 may be a second target object. Sixth object 524 may be a second type of prize (e.g., credits, free spins, multiplier, multi-level selections, free food, free room, free event tickets, and/or any other thing of value). In this example, second prize type may be free spins. Sixth object 524 may be a first sized object (e.g., small). Second target object may include many different sized (e.g., smallest, second smallest, medium, second biggest, biggest, any size from 1 to N) objects. Sixth object 524 may be the hardest object to hit. Sixth object 524 may be the hardest object to hit in second target object classification. Sixth object 524 may be associated with the largest prize pool. Sixth object 524 may be associated with the largest prize pool in second target object classification. Sixth object 524 may be associated with the largest prize pool based on the being the hardest object to hit. Sixth object 524 may be associated with any prize pool, crane category, crane presentation, crane structure, and/or any combination thereof based on any sixth object characteristic (e.g., hardest object to hit, easiest object to hit, largest object, smallest object, average sized object, size 1 object, size 2 object, category 1 object, category 2 object, prize amount 1 object, prize amount 2 object, etc.).

Seventh object 526 may be a third target object. Seventh object 526 may be a third type of prize (e.g., credits, free spins, multiplier, multi-level selections, free food, free room, free event tickets, and/or any other thing of value). In this example, third prize type may be a multiplier. Seventh object 526 may be a first sized object (e.g., small). Third target object may include many different sized (e.g., smallest, second smallest, medium, second biggest, biggest, any size from 1 to N) objects. Seventh object 526 may be the hardest object to hit. Seventh object 526 may be the hardest object to hit in third target object classification. Seventh object 526 may be associated with the largest prize pool. Seventh object 526 may be associated with the largest prize pool in third target object classification. Seventh object 526 may be associated with the largest prize pool based on the being the hardest object to hit. Seventh object 526 may be associated with any prize pool, crane category, crane presentation, crane structure, and/or any combination thereof based on any seventh object characteristic (e.g., hardest object to hit, easiest object to hit, largest object, smallest object, average sized object, size 1 object, size 2 object, category 1 object, category 2 object, prize amount 1 object, prize amount 2 object, etc.).

Eighth object 528 may be a fourth target object. Eighth object 528 may be a fourth type of prize (e.g., credits, free spins, multiplier, multi-level selections, free food, free room, free event tickets, and/or any other thing of value). In this example, fourth prize type may be credits and free spins. Eighth object 528 may be a first sized object (e.g., medium). Fourth target object may include many different sized (e.g., smallest, second smallest, medium, second biggest, biggest, any size from 1 to N) objects. Eighth object 528 may be an object with an average difficulty level to hit. Eighth object 528 may be an object with an average difficulty level to hit in fourth target object classification. Eighth object 528 may be associated with an average sized prize pool. Eighth object 528 may be associated with an average sized prize pool in fourth target object classification. Eighth object 528 may be associated with an average sized prize pool based on the being object with an average difficulty level to hit. Eighth object 528 may be associated with any prize pool, crane category, crane presentation, crane structure, and/or any combination thereof based on any eighth object characteristic (e.g., hardest object to hit, easiest object to hit, largest object, smallest object, average sized object, size 1 object, size 2 object, category 1 object, category 2 object, prize amount 1 object, prize amount 2 object, etc.).

Ninth object 530 may be a fifth target object. Ninth object 530 may be a fifth type of prize (e.g., credits, free spins, multiplier, multi-level selections, free food, free room, free event tickets, and/or any other thing of value). In this example, fifth prize type may be credits, free spins, and a multiplier. Ninth object 530 may be a first sized object (e.g., large). Fifth target object may include many different sized (e.g., smallest, second smallest, medium, second biggest, biggest, any size from 1 to N) objects. Ninth object 530 may be the easiest object to hit. Ninth object 530 may be the easiest object to hit in fifth target object classification. Ninth object 530 may be associated with the smallest prize pool. Ninth object 530 may be associated with the smallest prize pool in ninth target object classification. Ninth object 530 may be associated with the smallest prize pool based on the being the easiest object to hit. Ninth object 530 may be associated with any prize pool, crane category, crane presentation, crane structure, and/or any combination thereof based on any ninth object characteristic (e.g., hardest object to hit, easiest object to hit, largest object, smallest object, average sized object, size 1 object, size 2 object, category 1 object, category 2 object, prize amount 1 object, prize amount 2 object, etc.).

Tenth object 532 may be a sixth target object. Tenth object 532 may be a sixth type of prize (e.g., credits, free spins, multiplier, multi-level selections, free food, free room, free event tickets, and/or any other thing of value). In this example, sixth prize type may be a multi-level selection. Tenth object 532 may be a first sized object (e.g., large). Sixth target object may include many different sized (e.g., smallest, second smallest, medium, second biggest, biggest, any size from 1 to N) objects. Tenth object 532 may be the easiest object to hit. Tenth object 532 may be the easiest object to hit in sixth target object classification. Tenth object 532 may be associated with the smallest prize pool. Tenth object 532 may be associated with the smallest prize pool in sixth target object classification. Tenth object 532 may be associated with the smallest prize pool based on the being the easiest object to hit. Tenth object 532 may be associated with any prize pool, crane category, crane presentation, crane structure, and/or any combination thereof based on any tenth object characteristic (e.g., hardest object to hit, easiest object to hit, largest object, smallest object, average sized object, size 1 object, size 2 object, category 1 object, category 2 object, prize amount 1 object, prize amount 2 object, etc.).

Free ball object 613 may be one or more balls 612 which are released for multi-ball game play when free ball object 613 is hit.

In one embodiment, a player, electronic gaming device 100, and/or electronic gaming system 200 may select one or more of first object 514, second object 516, third object 518, fourth object 520, fifth object 522, sixth object 524, seventh object 526, eighth object 528, ninth object 530, and/or tenth object 532.

In various examples, the player, electronic gaming device 100, and/or electronic gaming system 200 may target 1 through $n^{th}$ of the objects available for selection. Any number of target objects, characters, weapons, objects, and/or selections may be utilized.

Figure 6B:
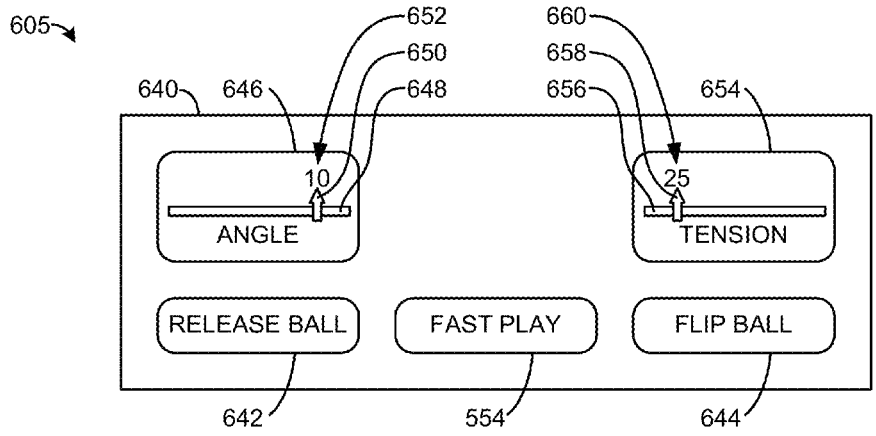
FIG. 6B is an illustration of a control panel for pinball-based game play, according to one embodiment.

FIG. 6B is an illustration of a pinball-based game play, according to one embodiment. A second pinball image 605 may include a pinball control area 640, an angle controller 646, a tension controller 654, a release ball button 642, fast play button 554, and/or a flipper ball button 644.

Pinball control area 640 may be an area where one or more control buttons (e.g., input devices) are located. In this example, pinball control area 640 may include angle controller 646, tension controller 654, release ball button 642, fast play button 554, and/or flipper ball button 644.

Angle controller 646 may include an angle indicator 650 located in an angle guider 648. In this example, an angle of 10 degrees may be indicated by an angle image 652. Any angle may be utilized. Angle controller 646 may control the angle of flipper 604, the angle of flipper base 606, the angle of ball ramp 608, the angle of the target objects, and/or any other game play angle.

Tension controller 654 may include a tension indicator 658 located in a tension guider 656. In this example, a tension of 24 may be indicated by a tension image 660. Any tension number may be utilized. Tension controller 654 may control the tension of flipper 604, the tension of flipper base 606, the tension (e.g., friction) on ball ramp 608, the tension (e.g., how easy the object is dislocated/released) of the target objects, and/or any other game play tension and/or friction.

Release ball button 642 may be utilized to release one or more balls 612. Fast play button 554 may be utilized to speed up the game, automate the game (e.g., electronic gaming device 100 and/or electronic gaming system 200 selects the object), and/or reduce the presentations.

Flipper ball button 644 may be utilized to move flipper 604. Flipper 604 may move in any direction (e.g., up, down, right, left, and/or any combination thereof).

Figure 6C:
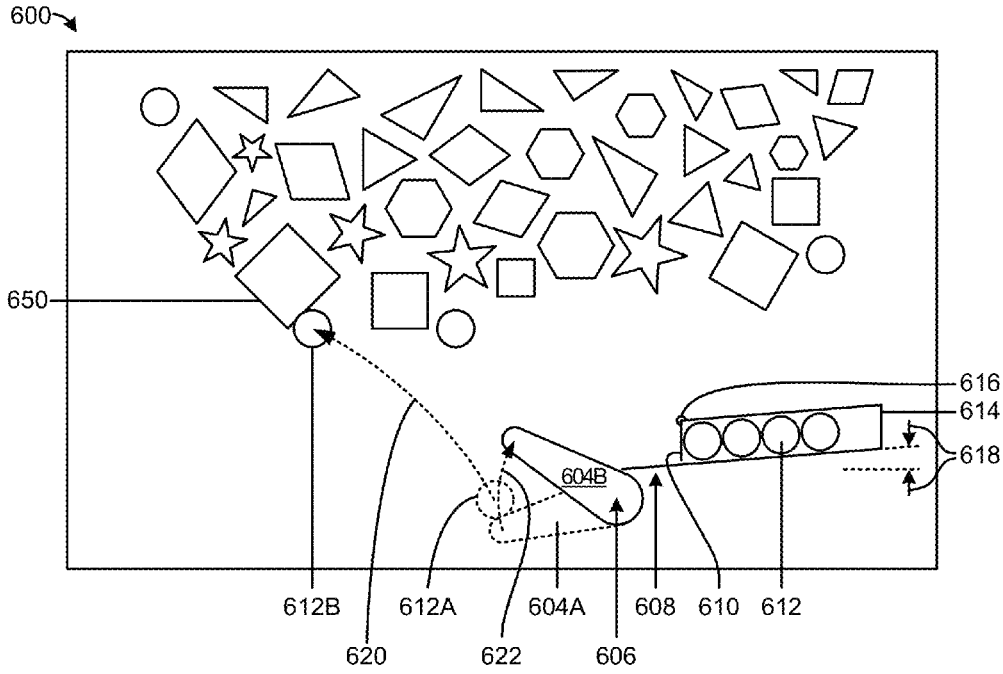
FIG. 6C is another illustration of a pinball-based game play, according to one embodiment.
Figure 6D:
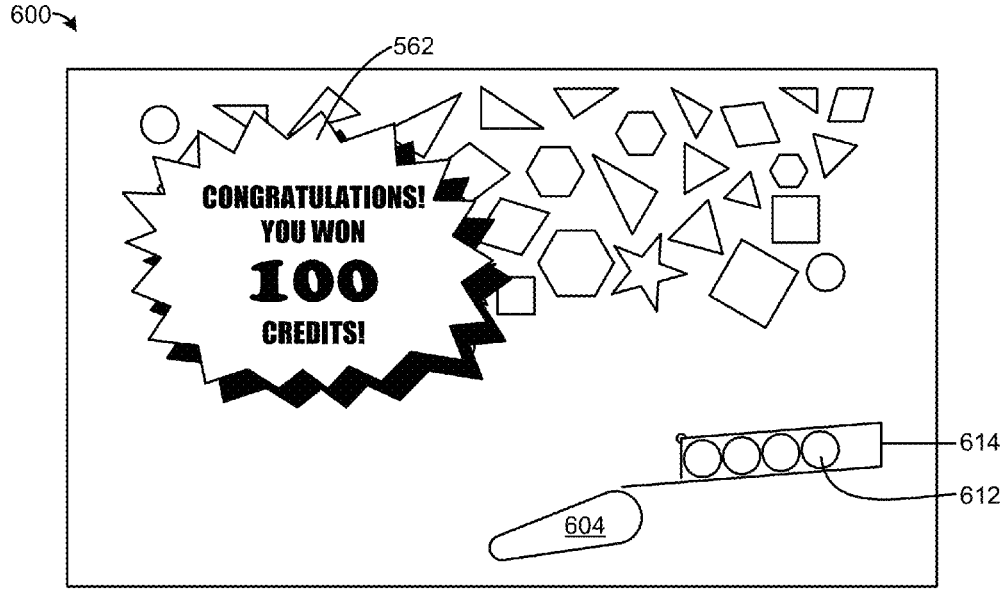
FIG. 6D is another illustration of a pinball-based game play, according to one embodiment.

FIG. 6C is an illustration of a pinball-based game play, according to one embodiment. In a pinball image 600, flipper 604 moves via a first flipper movement pattern 622 from a first flipper position 604A to a second flipper position 604B. First flipper movement pattern 622 may cause ball 612 to move via a first ball movement pattern 620 from a first ball position 612A to a second ball position 612B. At second ball position 612B, a first pinball object 650 may be released by ball 612. Once first pinball object 650 is released, the hidden prize related to first pinball object 650 may be revealed. In this example, a message may state "CONGRATULATIONS YOU WON 100 CREDITS!". (see FIG. 6D).

Figure 6E:
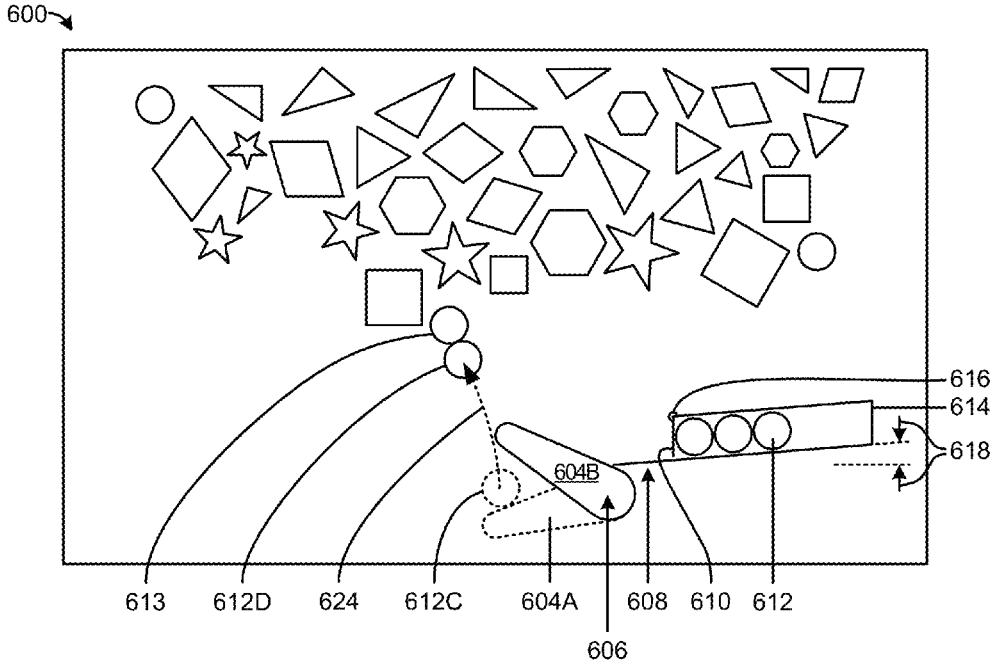
FIG. 6E is another illustration of a pinball-based game play, according to one embodiment.
Figure 6F:
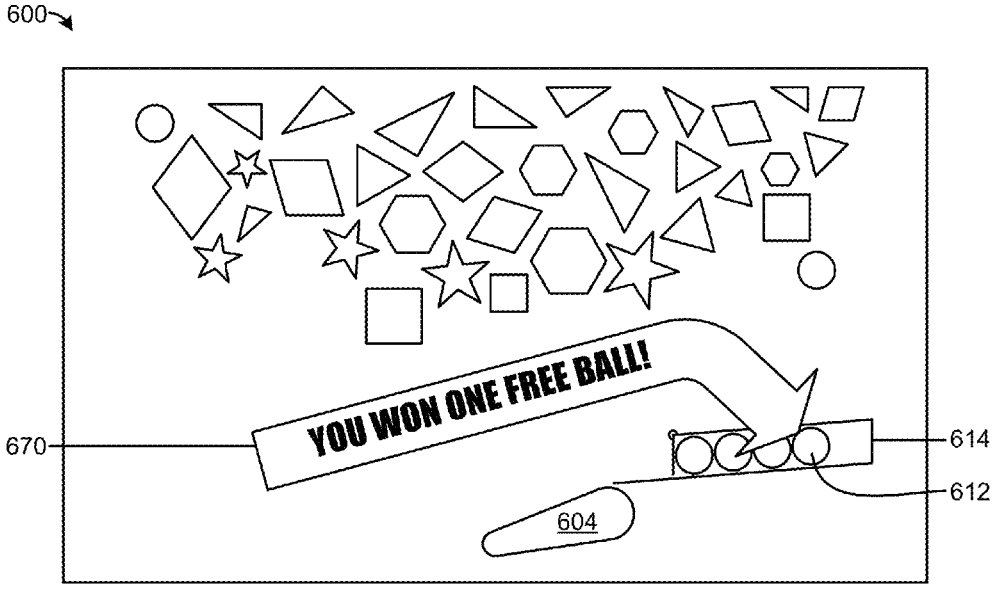
FIG. 6F is another illustration of a pinball-based game play, according to one embodiment.

FIG. 6E is an illustration of a pinball-based game play, according to one embodiment. In this example, pinball image 600 shows flipper 604 moving from first flipper position 604A to second flipper position 604B. Based on this flipper movement, ball 612 moves from a third ball position 612C to a fourth ball position 612D via a second ball movement pattern 624 and hits free ball object 613. In FIG. 6F, a free ball 612 is placed in ball area 614 because second ball movement pattern 624 has released free ball object 613 and/or free ball 612. A free ball message 670 may state "YOU WON ONE FREE BALL!".

Figure 6G:
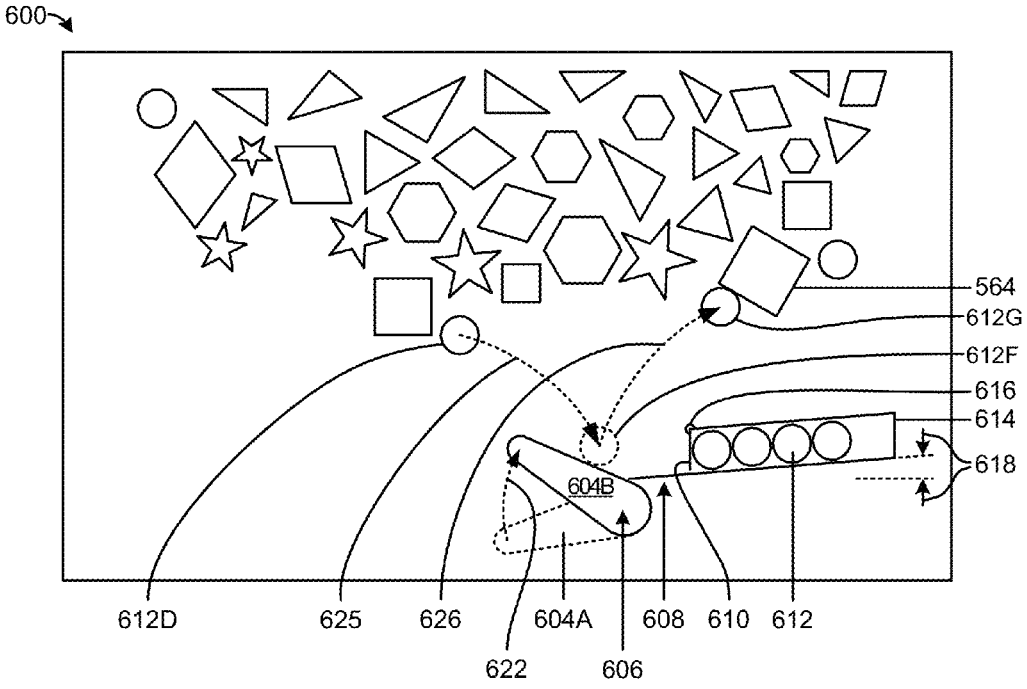
FIG. 6G is another illustration of a pinball-based game play, according to one embodiment.
Figure 6H:
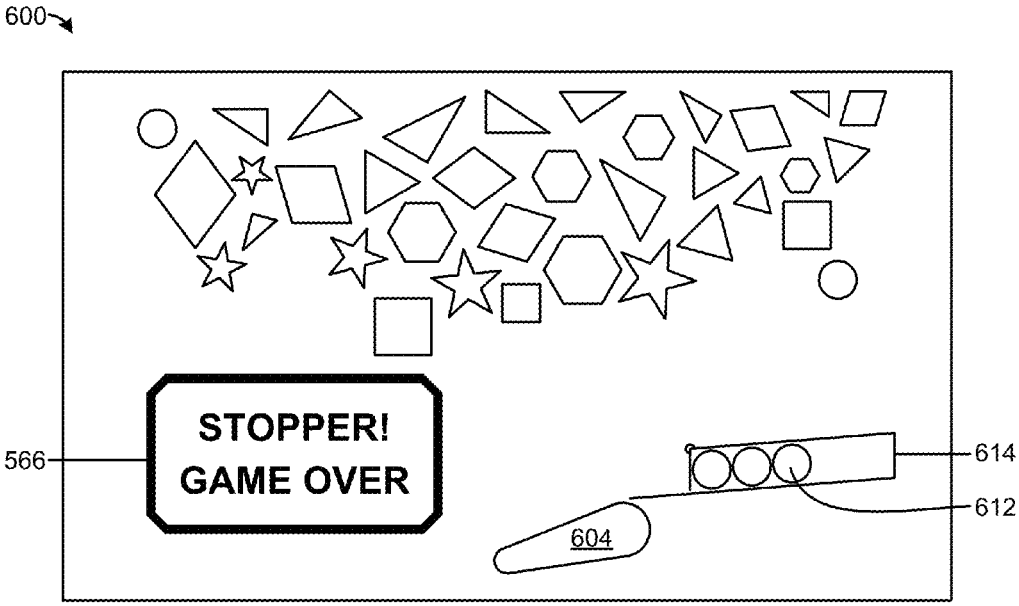
FIG. 6H is another illustration of a pinball-based game play, according to one embodiment.

FIG. 6G is an illustration of a pinball-based game play, according to one embodiment. In this example, pinball image 600 shows ball 612 moving from fourth ball position 612D after releasing free ball 612 back to flipper 604 at a fifth ball position 612E via a third ball movement pattern 625. Flipper 604 may launch ball 612 from fifth ball position 612E to a sixth ball position 612G via a fourth ball movement pattern 626 to release second prize object 564. Second prize object 564 was a game ending stopper, which was displayed by second message 566. In FIG. 6H, second message 566 may state "STOPPER! GAME OVER".

Figure 7:
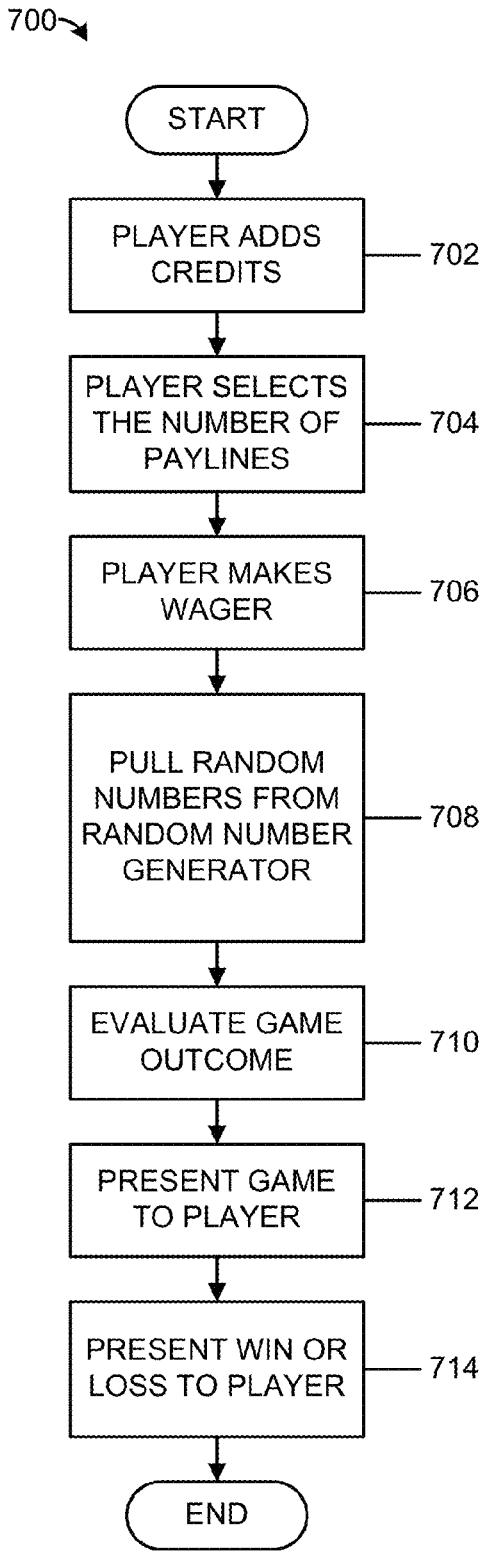
FIG. 7 is a flow diagram for game play, according to one embodiment.

FIG. 7 is a flow diagram for game play 700, according to one embodiment. The method may include the player adding credits (step 702). The method may further include the player selecting one or more paylines (step 704). The method may include the player making a wager on one or more paylines (step 706). The method may include pulling one or more random numbers via a random number generator (step 708). The method may include electronic gaming device 100 and/or electronic gaming system 200 evaluating the game outcome (step 710). The method may include presenting an outcome to a player (step 712). The method may present a win or a loss to the player (step 714). The method may end.

Figure 8:
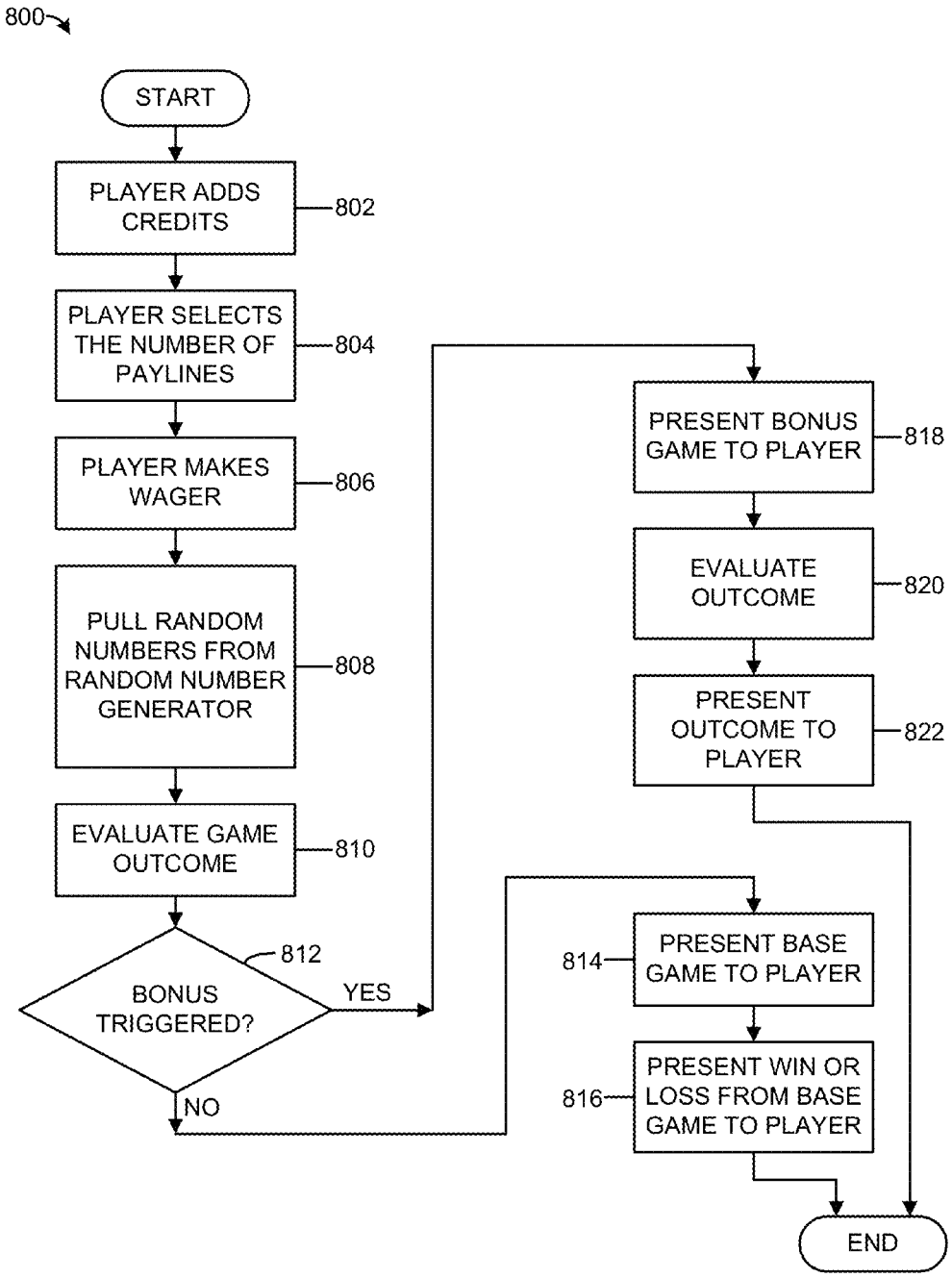
FIG. 8 is another flow diagram for game play, according to one embodiment.

FIG. 8 is a flow diagram for game play 800, according to one embodiment. The method may include the player adding credits (step 802). The method may further include the player selecting one or more paylines (step 804). The method may include the player making a wager on one or more paylines (step 806). The method may include pulling one or more random numbers via a random number generator (step 808). The method may include electronic gaming device 100 and/or electronic gaming system 200 evaluating the game outcome (step 810). The method may include electronic gaming device 100 and/or electronic gaming system 200 determining whether a bonus game has been triggered (step 812). If no bonus game has been triggered, then the method may include presenting a base game outcome to a player (step 814). The method may present a win or a loss from a base game to the player (step 816) and the method may end. If a bonus game has been triggered, then the method may include presenting a bonus game to the player (step 818). The method may include evaluating the bonus game outcome (step 820). The method may include presenting the bonus game outcome to the player (step 822) and the method may end.

For example, one or more bonus game triggers may initiate a crane-based game play. The player, electronic gaming device 100, and/or electronic gaming system 200 may try to pick up one or more objects. If one or more objects are picked up, then electronic gaming device 100 and/or electronic gaming system 200 may reveal a hidden prize. In another embodiment, the prize value may be displayed on the outside of an object to show the player what the prize value would be if this specific object was picked up. In another embodiment, one or more objects may be continually picked up until a stopper has been selected (e.g., picked up). In another embodiment, one or more objects may be picked up based on a number of chances (e.g., turns, attempts, etc.).

Figure 9:
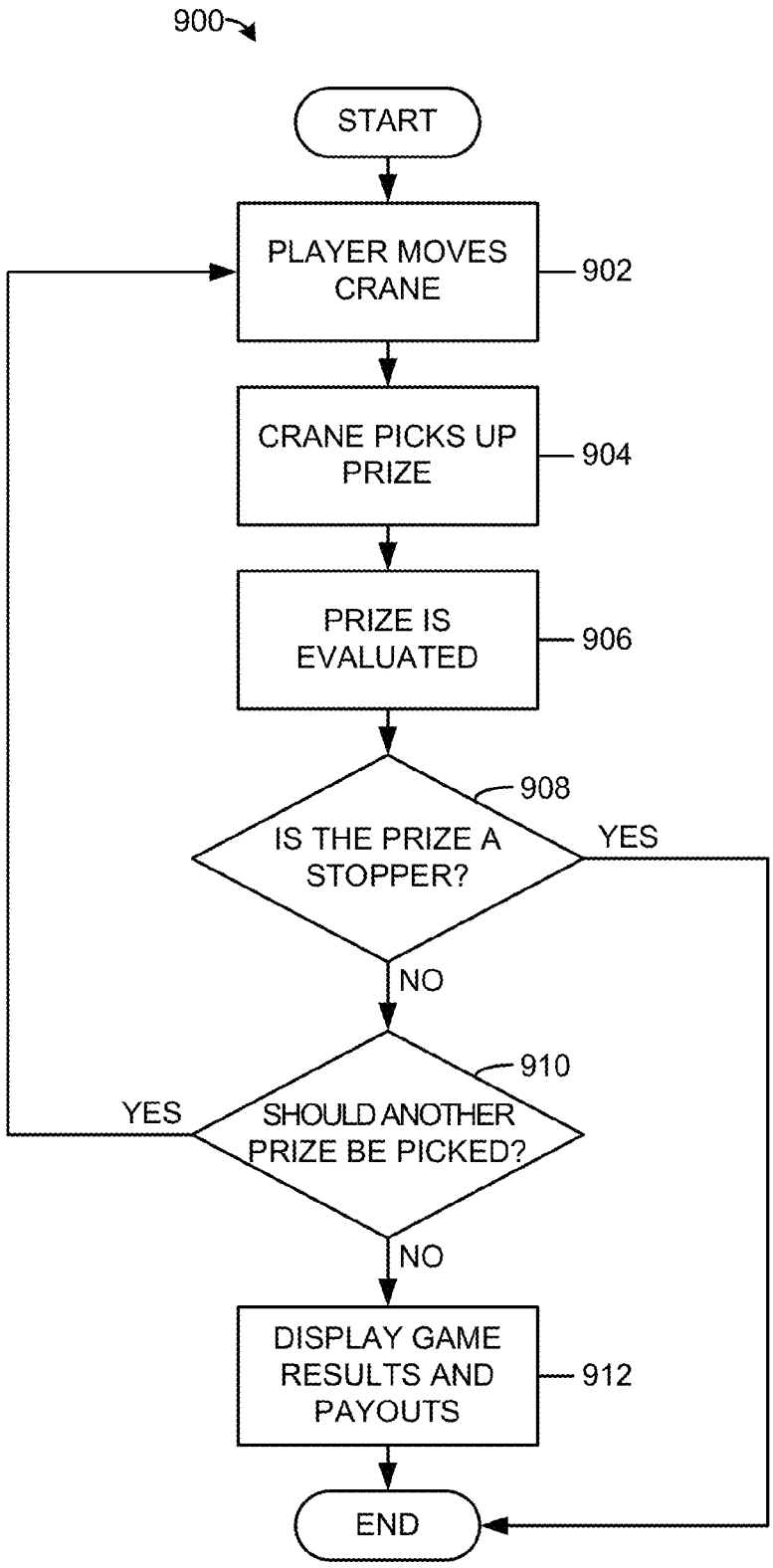
FIG. 9 is another flow diagram for game play, according to one embodiment.

FIG. 9 is another flow diagram for game play 900, according to one embodiment. The method may include starting a base game and/or bonus game, which includes physics-based game play (e.g., crane, pinball, sling shot, weapon-targeting game, etc.).

In the crane example, the method may include the player moving a crane (step 902). The method may include the crane picking up a prize (step 904). The method may include the prize being evaluated (step 906). The method may include electronic gaming device 100 and/or electronic gaming system 200 determining whether the prize is a stopper (step 908). If the prize is a stopper, then the method may end. If the prize is not a stopper, then the method may include electronic gaming device 100 and/or electronic gaming system 200 determining whether another prize should be picked (step 910). If no additional prize should be picked, then the method may display the game results and payouts (step 912) and the method may end. If one or more additional prizes should be picked, then the method moves back to step 902.

For example, a player may pick up a first object which has a value of 1,000 credits. Electronic gaming device 100 and/or electronic gaming system 200 may determine that the player had 3 turns before the last turn was executed and now has 2 turns. Therefore, the player may pick up a second object which has a value of 500 credits and 1 free turn. Electronic gaming device 100 and/or electronic gaming system 200 may determine that the player had 2 turns before the last turn was executed and now has 1 turns plus the 1 free turn for a total of 2 turns. The player may pick up a third object which has a value of 1,500 credits. Electronic gaming device 100 and/or electronic gaming system 200 may determine that the player had 2 turns before the last turn was executed and now has 1 turns. The player may pick up a fourth object which has a 2× multiplier value which may increase all of the credits (e.g., 3,000) by a factor of 2 (e.g., 6,000 credits). Electronic gaming device 100 and/or electronic gaming system 200 may determine that the player had 1 turn before the last turn was executed and now has 0 turns. The bonus round may end when the player has 0 turns remaining.

One or more presentations may be based on a first theme (e.g., pirates), a second theme (e.g., cars), a third theme (e.g., horses), a fourth theme (e.g., perceived skill), a fifth theme (e.g., a specific movie), a sixth theme (e.g., a sporting event), a seventh theme (e.g., outer space), an eight theme (e.g., flowers), a ninth theme (e.g., food), a tenth theme (e.g., a skill based presentation), an eleventh theme (e.g., trivia), a twelve theme (e.g., pick a bonus), a thirteenth theme (e.g., ghost), a fourteenth theme (e.g., natural events), on a fifteenth theme (e.g., a mineral—gold, silver, etc.), and/or a sixteenth theme (e.g., mythology). One, a few, a plurality, and/or all of these presentations may be themed based.

In one example, the method may include determining a triggering event (e.g., a winning credit amount). The method may include looking up one or more presentations relating to the triggering event (e.g., a winning credit amount). The method may include selecting one or more presentations from the one or more presentations related to the triggering event (e.g., a winning credit amount) based on one or more criteria. The method may include displaying the selected one or more presentations. The method may end.

In one example, the system and/or method may determine that a key value (e.g., winning amount) is 10,000 credits. The key value may be the amount of credits (and/or multipliers and/or free spins and/or any other item of value) won. In this example, the 10,000 credit key value number may be utilized to determine one or more presentations associated with this 10,000 credits key value number. There may be presentation indexes numbered 0 to N associated with the 10,000 credits key value number.

The system and/or method may select (e.g., randomly, by a predetermined pattern, shuffle, combination thereof, and/or any other selection method) one or more of the presentations based on the key value.

In one example, the method may include determining a winning credit amount. The method may include looking up one or more presentations related to the winning credit amount. The method may include modifying the set of presentations relating to the winning credit amount based on one or more criteria. The method may include selecting a presentation from the modified set of presentations based on one or more criteria. The method may include displaying the selected presentation. The method may end.

For example, the presentation may be modified to include an advertisement, a movie trailer, a movie promotion, a casino event, a casino promotion, an actor's image, the player's image, etc.

In one embodiment, the electronic gaming device may include a plurality of reels, one or more paylines formed on at least a portion of the plurality of reels, a memory, and a processor. The memory may include a presentation module. The presentation module may include a plurality of presentations. The processor may determine a value. The processor may select one or more presentations based on the value.

In another example, the processor may randomly select the one or more presentations related to the value. In an example, the processor may select the one or more presentations related to the value in a predetermined pattern.

In another example, the value may be based on an input from a player. In an example, the processor may display a presentation based on one or more presentations. In another example, the processor may display a themed presentation based on one or more criteria. In an example, the themed presentation may be based on an advertisement and/or any other theme.

In another embodiment, the method of providing gaming options via an electronic gaming device may include receiving one or more primary wagers on one or more paylines, starting a bonus game, determining one or more values, and/or selecting one or more presentations based on the one or more values.

In an exemplary embodiment, an electronic gaming device may include a plurality of reels. The plurality of reels may include a plurality of symbols. The electronic gaming device may include a first payline, a second payline, and a memory. The memory may include a payline module. The payline module may include a plurality of payline structures. The electronic gaming device may include a processor. The processor may receive primary wagers on one or more paylines. The processor may receive one or more secondary wagers on one or more selected paylines (e.g., repeat paylines, patterns, scenarios, etc.). The selected paylines may be based on data received from a player. The processor may determine a selected payline's payout based on the one or more selected paylines (e.g., repeat paylines, patterns, scenarios, etc.).

In another embodiment, the processor may determine a payout based on the primary wagers. The electronic gaming device may include a network interface, which may receive data from at least one of a server and one or more gaming devices. The electronic gaming device may include a display, which may display one or more selected paylines.

In another example, the display may shade one or more non-selected paylines. The electronic gaming device may include a player preference input device. The player preference input device may modify a game configuration based on data from an identification device. The processor may multiply a prize value based on a selected payline occurrence.

In another embodiment, a method of game play may include receiving one or more primary wagers on one or more paylines. The method may include receiving a secondary wager on one or more paylines (e.g., repeat paylines, patterns, scenarios, etc.). The selected payline may be based on selection data. The selection data may be based on player input. The method may include determining one or more primary wager payouts. Further, the method may include determining one or more secondary wager payouts.

In another example, the method may include obtaining a player preference data and modifying a game configuration based on the player preference data. The method may include receiving data from at least one of a server and one or more gaming devices. The method may include multiplying a prize value based on a selected payline occurrence.

In one embodiment, the electronic gaming device may include a plurality of reels. The plurality of reels may include a plurality of symbols. One or more paylines may be formed on a portion of the plurality of reels. The electronic gaming device may include a memory. The memory may include a payline module. The payline module may include a plurality of payline structures. The electronic gaming device may include a processor, which receives primary wagers on one or more paylines. The processor may also receive one or more secondary wagers on one or more repeat paylines. The processor may determine one or more repeat payline payouts based on the one or more repeat paylines.

In another example, the processor may determine a payout based on the primary wagers. The processor may receive one or more secondary wagers on one or more patterns. The electronic gaming device may include a display, which may display a game status image.

In another example, the display may shade one or more completed repeat paylines. The electronic gaming device may include a player preference input device. The player preference input device may modify a game configuration based on data from an identification device. In another embodiment, the processor may multiply a prize value based on a repeat payline occurrence.

In an embodiment, a method may include receiving one or more primary wagers on one or more paylines. The method may include receiving a secondary wager on one or more repeat paylines. The method also may include determining one or more primary wager payouts. The method may include determining one or more secondary wager payouts.

In another example, a primary wager payout may be based on the one or more paylines and a secondary wager payout may be based on the one or more repeat paylines. The method may include receiving one or more secondary wagers on one or more patterns.

In another example, the method may include displaying a game status image. The method may also include shading one or more completed objectives (e.g., selecting any element, obtaining a repeat payline, etc.).

In another example, the method may include displaying paylines based on the one or more primary wagers. The method may include displaying the one or more repeat paylines. The method may include highlighting one or more repeat paylines. The method may include obtaining a player preference data and modifying a game configuration based on the player preference data.

In another embodiment, the electronic gaming system may include a server. The server may include a server memory, a server processor, and a signage server. The server memory may include historical gaming data. The server processor may generate a gaming message based on the historical gaming data. The signage server may transmit the gaming message.

In another example, the gaming message may be transmitted to an internal display of a gaming entity. The internal display may be a non-gaming device display. The gaming message may be transmitted to an external display of a gaming entity. The external display may be located outside of a gaming entity. The gaming message may be transmitted to at least one of a top display, a main display, and a side display.

The plurality of reels may form a 5-by-5 matrix, a 3-by-5 matrix, a 4-by-5 matrix, a 4-by-3 matrix, a 5-by-3 matrix, or any number-by-any number matrix. The symbols may be an image of a card, an image, and/or other objects. For example, it could be a pot of gold, an ace of spades, a diamond, or any other symbol. The symbols may be animation. The symbols may be a picture. For example, it may be a picture of the player as taken by camera 312. The symbols may be a number. The symbols may be any image. The symbols may be blank.

The disclosed features may be part of the base game and/or a bonus game. In addition, the disclosed features may be part of a base bet and/or may require an additional side bet (e.g., ante bet).

In one embodiment, the electronic gaming device may include a plurality of reels. One or more paylines may be formed on a portion of the plurality of reels. The electronic gaming device may include a memory. The memory may include a plurality of game ending objects and/or a plurality of game ending object stoppers. The electronic gaming device may include a processor which may obtain one or more game ending object stopper selections.

In one embodiment, the electronic gaming device may include a plurality of reels. One or more paylines may be formed on one or more reels. The electronic gaming device may include a memory and a processor. The memory may include one or more physics-based game play structures. The processor may initiate the one or more physics-based game play structures based on a triggering event.

In another example, an initiated physics-based game play structure may be a crane-based game. The processor may move a crane based on input from a player, electronic gaming device, and/or electronic gaming system. The processor may determine a status of one or more objects based on crane movement data. The processor may reveal data relating to the one or more objects based on the status of the one or more objects.

In one example, the revealed data may be a prize amount. The processor may display via a display a payout based on the prize amount. In another example, the revealed data may be a stopper.

In another embodiment, a method may include receiving one or more wagers on one or more paylines. The method may also include determining one or more triggering events. The method may further include displaying one or more physics-based game play structures.

In one example, the method may include that a crane-based game is one of the one or more physics-based game play structures. The method may further include moving a crane based on input from a player. The method may include determining one or more statuses of one or more objects based on crane movement data. The method may include revealing data relating to the one or more objects based on one or more statuses of the one or more objects.

In one example, the method may include that a revealed data is a prize amount. The method may include displaying a payout based on the prize amount. In another example, the method may include that a revealed data is a stopper.

In another embodiment, the electronic gaming system may include a server. The server may include a server memory and a server processor. The server memory may include one or more physics-based game play structures. The server processor may initiate the one or more physics-based game play structures based on a triggering event.

In one example, the electronic gaming system may utilize an initiated physics-based game play structure which may be a crane-based game.

In another example, the server processor may move a crane based on input from a player. The server processor may determine a status of one or more objects based on crane movement data.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device comprising:

a plurality of reels;

one or more paylines formed on at least a portion of the plurality of reels;

a memory, the memory including one or more physics-based game play structures, the one or more physics-based game play structures including crane categories where the crane categories include at least a first crane category and a second crane category, the first crane category having a first play level and the second crane category having a second play level; and a processor configured to initiate at least one of the first crane category and the second crane category of the one or more physics-based game play structures based on a triggering event, the processor configured to display a first video crane presentation based on a first crane game play initiation associated with the first crane category and to display a second video crane presentation based on a second crane game play initiation associated with the second crane category.

2. The electronic gaming device of claim 1, wherein the processor is further configured to move a crane based on input from a player.

3. The electronic gaming device of claim 2, wherein the processor is further configured to determine a status of one or more objects based on crane movement data.

4. The electronic gaming device of claim 3, wherein the processor is further configured to reveal data relating to the one or more objects based on the status of the one or more objects.

5. The electronic gaming device of claim 4, wherein a revealed data is a prize amount.

6. The electronic gaming device of claim 5, wherein the processor is further configured to display a payout based on the prize amount.

7. The electronic gaming device of claim 4, wherein a revealed data is a stopper.

8. A method of providing gaming options via an electronic gaming device comprising:

receiving one or more wagers on one or more paylines;

determining one or more triggering events; and displaying at least one of a first crane category and a second crane category of one or more physics-based game play structures, wherein the one or more physics-based game play structures including crane categories where the crane categories include at least the first crane category and the second crane category and wherein the first crane category having a first play level and the second crane category having a second play level and where a first video crane presentation is displayed based on a first crane game play initiation associated with the first crane category and where a second video crane presentation is displayed based on a second crane game play initiation associated with the second crane category.

9. The method of claim 8, further comprising moving a crane based on input from a player.

10. The method of claim 9, further comprising determining one or more statuses of one or more objects based on crane movement data.

11. The method of claim 10, further comprising revealing data relating to the one or more objects based on one or more statuses of the one or more objects.

12. The method of claim 11, wherein a revealed data is a prize amount.

13. The method of claim 12, further comprising displaying a payout based on the prize amount.

14. The method of claim 11, wherein a revealed data is a stopper.

15. An electronic gaming system comprising:

a server including a server memory and a server processor, the server memory including one or more physics-based game play structures, the one or more physics-based game play structures including crane categories where the crane categories include at least a first crane category and a second crane category, the first crane category having a first play level and the second crane category having a second play level;

the server processor configured to initiate at least one of the first crane category and the second crane category of the one or more physics-based game play structures based on a triggering event, the server processor configured to display a first video crane presentation based on a first crane game play initiation associated with the first crane category and to display a second video crane presentation based on a second crane game play initiation associated with the second crane category.

16. The electronic gaming system of claim 15, wherein the server processor is further configured to move a crane based on input from a player.

17. The electronic gaming system of claim 16, wherein the server processor is further configured to determine a status of one or more objects based on crane movement data.

* * * * *